US009207581B2

(12) United States Patent
Wada et al.

(10) Patent No.: US 9,207,581 B2
(45) Date of Patent: Dec. 8, 2015

(54) DEVELOPER ACCOMMODATING UNIT, DEVELOPING DEVICE, PROCESS CARTRIDGE AND IMAGE FORMING APPARATUS

(71) Applicant: CANON KABUSHIKI KAISHA, Tokyo (JP)

(72) Inventors: Koji Wada, Kawasaki (JP); Takashi Kase, Tokyo (JP); Takayuki Kanazawa, Yokohama (JP); Yusuke Usui, Tokyo (JP); Masaki Furutani, Tokyo (JP); Kojiro Yasui, Numazu (JP); Hiroomi Matsuzaki, Mishima (JP); Tetsuo Uesugi, Yokohama (JP); Tatsuo Fujisaki, Yokohama (JP); Masaaki Matsushita, Yokohama (JP); Junichi Matsumura, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/293,450

(22) Filed: Jun. 2, 2014

(65) Prior Publication Data

US 2014/0363196 A1 Dec. 11, 2014

(30) Foreign Application Priority Data

Jun. 5, 2013 (JP) ..... 2013-118885
Mar. 19, 2014 (JP) ..... 2014-056386

(51) Int. Cl.
*G03G 15/08* (2006.01)
*G03G 21/16* (2006.01)

(52) U.S. Cl.
CPC ..... *G03G 15/0898* (2013.01); *G03G 15/0841* (2013.01); *G03G 15/0874* (2013.01); *G03G 15/0882* (2013.01); *G03G 21/1676* (2013.01); *G03G 2215/0682* (2013.01); *G03G 2215/0687* (2013.01); *G03G 2215/0875* (2013.01)

(58) Field of Classification Search
CPC ..... G03G 15/0841; G03G 15/0874; G03G 15/0882; G03G 15/0898; G03G 21/1676; G03G 2215/0682; G03G 2215/0687; G03G 2215/0875
See application file for complete search history.

(56) References Cited

U.S. PATENT DOCUMENTS

| | | | | | |
|---|---|---|---|---|---|
| 4,998,140 | A | * | 3/1991 | Satou et al. | 399/105 |
| 5,142,335 | A | * | 8/1992 | Sakata et al. | 399/106 |
| 5,943,529 | A | | 8/1999 | Miyabe et al. | |
| 5,966,567 | A | | 10/1999 | Matsuzaki et al. | |
| 6,011,941 | A | | 1/2000 | Takashima et al. | |

(Continued)

FOREIGN PATENT DOCUMENTS

| | | | | |
|---|---|---|---|---|
| JP | 03221981 | A | * | 9/1991 |
| JP | H0466980 | | | 3/1992 |
| JP | H 05-197288 | A | | 8/1993 |

OTHER PUBLICATIONS

U.S. Appl. No. 14/314,638, filed Jun. 25, 2014.

*Primary Examiner* — Ryan Walsh
(74) *Attorney, Agent, or Firm* — Fitzpatrick, Cella, Harper & Scinto

(57) ABSTRACT

A developer accommodating unit for accommodating a developer includes: an accommodating portion, provided with an opening, for accommodating the developer; a sealing member for sealing the opening; and an unsealing member rotatable for winding up the sealing member. The sealing member is peelable off from the accommodating portion to unseal the opening in a first unsealing direction and a second unsealing direction opposite to the first unsealing direction.

22 Claims, 17 Drawing Sheets

(56) References Cited

U.S. PATENT DOCUMENTS

| | | | | |
|---|---|---|---|---|
| 6,097,906 | A | 8/2000 | Matsuzaki et al. | |
| 6,144,815 | A | 11/2000 | Chadani et al. | |
| 6,173,140 | B1 | 1/2001 | Suzuki et al. | |
| 6,173,145 | B1 | 1/2001 | Chadani et al. | |
| 6,205,305 | B1 | 3/2001 | Suzuki et al. | |
| 6,219,504 | B1 | 4/2001 | Matsuzaki et al. | |
| 6,282,389 | B1 | 8/2001 | Matsuzaki et al. | |
| 6,334,035 | B1 * | 12/2001 | Abe et al. | 399/106 |
| 6,405,004 | B2 | 6/2002 | Matsuzaki et al. | |
| 6,549,736 | B2 | 4/2003 | Miyabe et al. | |
| 6,681,088 | B2 | 1/2004 | Kanno et al. | |
| 6,792,229 | B2 | 9/2004 | Matsuzaki | |
| 6,795,666 | B2 | 9/2004 | Miyabe et al. | |
| 6,859,629 | B2 | 2/2005 | Miura et al. | |
| 6,931,226 | B2 | 8/2005 | Chadani et al. | |
| 6,934,485 | B2 | 8/2005 | Miyabe et al. | |
| 6,978,100 | B2 | 12/2005 | Yasui et al. | |
| 7,016,626 | B2 | 3/2006 | Yokomori et al. | |
| 7,068,965 | B2 | 6/2006 | Yoshino et al. | |
| 7,085,516 | B2 | 8/2006 | Kawai et al. | |
| 7,103,291 | B2 * | 9/2006 | Odani | 399/27 |
| 7,155,137 | B2 | 12/2006 | Yasui et al. | |
| 7,224,925 | B2 | 5/2007 | Sato et al. | |
| 7,349,657 | B2 | 3/2008 | Sato et al. | |
| 7,412,193 | B2 | 8/2008 | Sato et al. | |
| 2011/0020031 | A1 | 1/2011 | Sato et al. | |
| 2011/0170906 | A1 | 7/2011 | Matsushita et al. | |
| 2012/0163876 | A1 | 6/2012 | Wada | |
| 2012/0301189 | A1 | 11/2012 | Kase et al. | |
| 2013/0136489 | A1 | 5/2013 | Yamaguchi et al. | |
| 2013/0164039 | A1 | 6/2013 | Matsushita et al. | |
| 2013/0164040 | A1 | 6/2013 | Matsushita et al. | |
| 2013/0336679 | A1 | 12/2013 | Furutani et al. | |
| 2013/0343785 | A1 | 12/2013 | Matsuzaki et al. | |
| 2014/0016961 | A1 | 1/2014 | Yasui et al. | |
| 2014/0029974 | A1 | 1/2014 | Uesugi et al. | |
| 2014/0064793 | A1 | 3/2014 | Matsuzaki et al. | |
| 2014/0072329 | A1 | 3/2014 | Uesugi et al. | |
| 2014/0072330 | A1 | 3/2014 | Yoshida et al. | |
| 2014/0072331 | A1 | 3/2014 | Matsushita et al. | |
| 2014/0072345 | A1 | 3/2014 | Matsunaga et al. | |
| 2014/0072346 | A1 | 3/2014 | Furutani et al. | |
| 2014/0072347 | A1 | 3/2014 | Furutani et al. | |
| 2014/0079432 | A1 | 3/2014 | Matsuzaki et al. | |
| 2014/0126928 | A1 | 5/2014 | Batori et al. | |
| 2014/0199092 | A1 | 7/2014 | Matsushita et al. | |
| 2014/0199093 | A1 | 7/2014 | Yoshida et al. | |
| 2014/0199094 | A1 | 7/2014 | Matsuzaki et al. | |
| 2014/0199096 | A1 | 7/2014 | Yoshida et al. | |

* cited by examiner (a)

(b)

(a)

(b)

DEVELOPER ACCOMMODATING UNIT, DEVELOPING DEVICE, PROCESS CARTRIDGE AND IMAGE FORMING APPARATUS

FIELD OF THE INVENTION AND RELATED ART

The present invention relates to a developer accommodating unit for accommodating a developer for forming an image on a recording material (medium) by an electrophotographic type (scheme), and a developing device, a process cartridge and an image forming apparatus each including the developer accommodating unit.

In the image forming apparatus of the electrophotographic type, a cartridge type in which at least a developing means and a developing device accommodating the developer and integrally constituted and detachably mountable to the image forming apparatus or in which the developing device and an image bearing member unit including at least an image bearing member are integrally constituted and detachably mountable to the image forming apparatus has been widely used.

Here, the developer is accommodated in a developer accommodating portion in the developing device provided with an opening, and the opening is sealed by a toner seal as a sealing member before use of the cartridge. Further, at the time of start of the use of the cartridge, the toner seal is peeled off from the opening to unseal (expose) the opening, so that the developer is suppliable (Japanese Laid-Open Patent Application (JP-A) Hei 5-197288).

As the developer accommodating portion, for the purpose of improving operativity of supply of the developer, a developer accommodating portion using a deformable flexible container has been devised (JP-A Hei 4-66980). In this case, the developer accommodating portion is provided with an opening, and before initial use of a cartridge, the opening is sealed by a single sealing member. Then, at the time of start of the initial use, the opening is opened (exposed) by peeling off a bonding portion of a toner seal as the sealing member, so that a developer is suppliable.

However, in the above-described developing devices, it took time to remove the toner seal and therefore there was a need to improve an unsealing property.

SUMMARY OF THE INVENTION

The present invention has solved the above-described problem. A principal object of the present invention is to provide a developer accommodating unit capable of shortening an unsealing time of a sealing member and capable of improving an unsealing property.

According to an aspect of the present invention in order to achieve the above object, there is provided a developer accommodating unit for accommodating a developer, comprising: an accommodating portion, provided with an opening, for accommodating the developer; a sealing member for sealing the opening; and an unsealing member rotatable for winding up the sealing member, wherein the sealing member is peelable off from the accommodating portion to unseal the opening in a first unsealing direction and a second unsealing direction opposite to the first unsealing direction.

These and other objects, features and advantages of the present invention will become more apparent upon a consideration of the following description of the preferred embodiments of the present invention taken in conjunction with the accompanying drawings.

DESCRIPTION OF THE EMBODIMENTS

Embodiments of a developer accommodating unit according to the present invention and an image forming apparatus using the developer accommodating unit will be described.

First Embodiment

<General Structure of Image Forming Apparatus>

Figure 1:
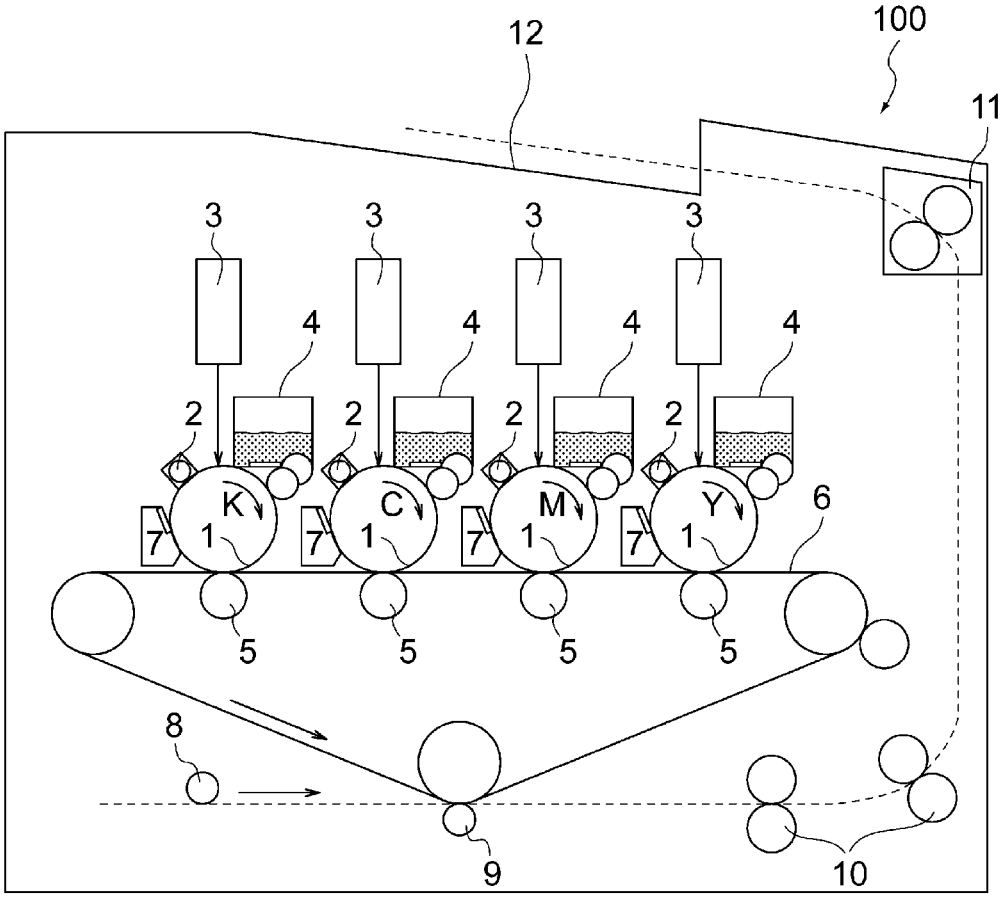
FIG. 1 is a schematic sectional view of an image forming apparatus.

FIG. 1 is a schematic illustration of an image forming apparatus according to this embodiment of the present invention. An image forming apparatus 100 is a full-color laser printer employing an in-line type and an intermediary transfer type.

The image forming apparatus 100 includes a plurality of image forming portions for forming images of colors of yellow (Y), magenta (M), cyan (C) and black (K), respectively. Incidentally, the image forming portions for the respective colors have the substantially same constitution except that the colors of toners accommodated therein are different from each other.

A structure of the image forming apparatus will be described together with an image forming operation. During image formation, each of photosensitive drums 1 is rotated in an arrow direction in FIG. 1, and a toner image (developer image) of an associated color is formed by an electrophotographic type, and then the toner image is successively transferred onto an intermediary transfer belt 6 as an intermediary transfer member, so that a color image is formed.

Specifically, a peripheral surface of each photosensitive drum 1 as an image bearing member is electrically charged uniformly by a charging roller 2, and then is irradiated with light depending on an image signal by a laser beam scanner 3 as an exposure means, so that an electrostatic latent image is formed. Then, the electrostatic latent image is developed by a developing device 4.

The developing device 4 includes a developer accommodating unit for accommodating the toner as a developer and a developing roller as a developer carrying member for supplying the toner, fed from the developer accommodating unit, to the photosensitive drum 1. Further, by supplying the toner depending on the electrostatic latent image formed on the photosensitive drum 1, so that the electrostatic latent image is developed with the toner to be visualized. The thus-visualized toner images are successively transferred for colors of yellow, magenta, cyan and black, respectively, onto the intermediary transfer belt 6 by bias application to each of primary transfer rollers, so that a full-color image is formed. The toner remaining on each of the photosensitive drums 1 after the toner image transfer is removed by an associated cleaning member 7.

Incidentally, the photosensitive drum 1, the charging roller 2, the developing device 4 and the cleaning member 7 are provided as a process cartridge detachably mountable to a main assembly of the image forming apparatus.

A recording material is fed from an unshown sheet cassette to a secondary transfer portion by a feeding roller 8 and the like so as to be synchronized with the above-described image formation. At the secondary transfer portion, by bias application to a secondary transfer roller 9, the toner image transferred on the intermediary transfer belt 6 is transferred onto the fed recording material.

The recording material on which the toner image is transferred is fed to a fixing device 11, and then is heated and pressed, so that the toner image is fixed thereon, and then the recording material is discharged onto a discharge portion.

<Developing Device>

Figure 2:
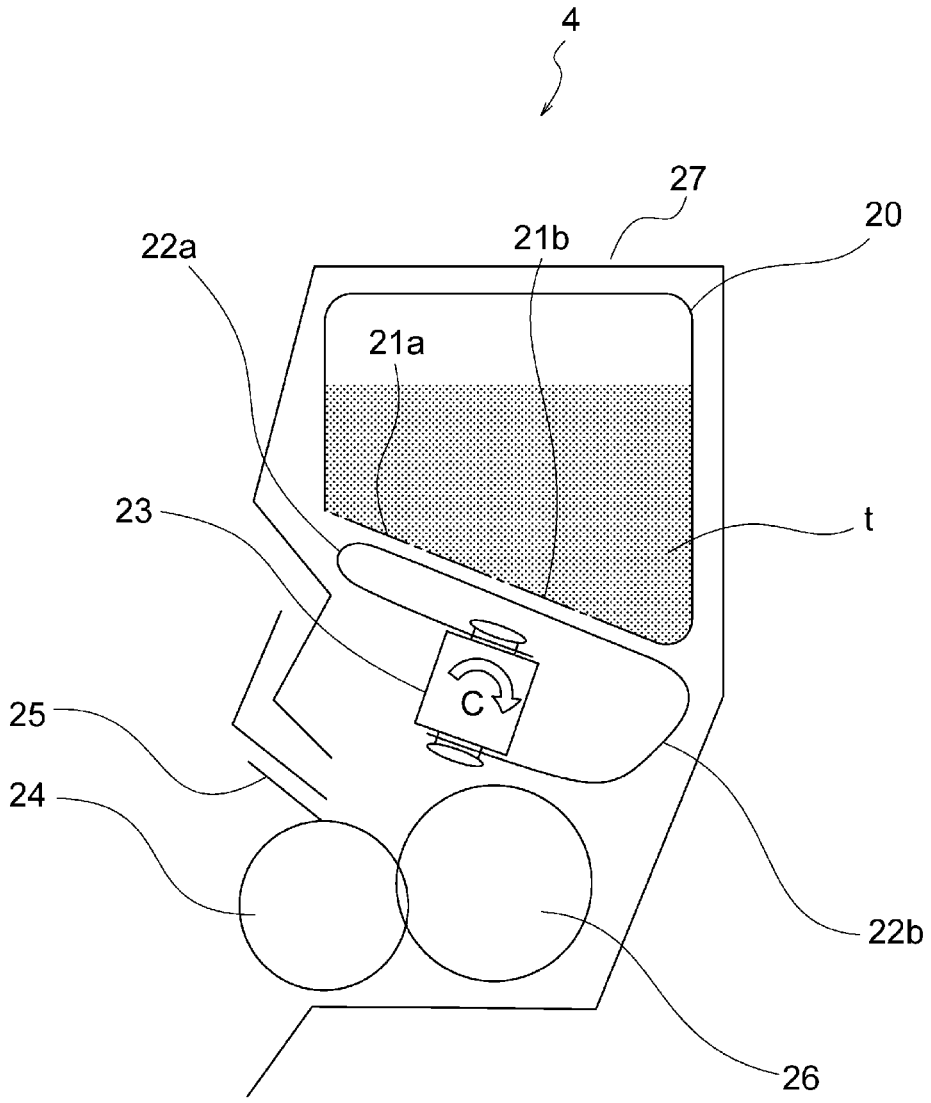
FIG. 2 is a schematic sectional view of a developing device.

Next, the developing device 4 according to this embodiment will be described. FIG. 2 is a schematic view of the developing device 4 in this embodiment. The developing device 4 includes a developer accommodating unit and a developing portion. The developer accommodating unit includes a developer accommodating portion 20 as a flexible container, sealing members 22*a* and 22*b* for sealing openings 21*a* and 21*b* formed at the developer accommodating unit 20, and an unsealing member 23 for removing the sealing members 22*a* and 22*b*. Further, the developing portion includes a developing roller 24 as a developer carrying member for developing the electrostatic latent image formed on the photosensitive drum 1, a developing blade 25 for regulating a layer thickness of the developer carried on the developing roller 24, and a developer supplying roller 26 for supplying the developer to the developing roller 24.

The developing roller 24 is a rubber roller prepared by forming an elastic rubber member on an outer peripheral surface on an electroconductive core metal. The developing roller 24 rotates so that surfaces of the developing roller 24 and the photosensitive drum 1 move in the same direction at an opposing portion therebetween. Then, by a predetermined bias applied to the developing roller 24, the toner is transferred onto the electrostatic latent image formed on the photosensitive drum 1 to visualize the electrostatic latent image.

The developer supplying roller 26 is an elastic sponge roller prepared by forming a foam member on an outer peripheral surface of an electroconductive core metal. The developer supplying roller 26 is disposed in contact with the developing roller 24 with a predetermined penetration amount, so that a predetermined nip is formed on the peripheral surface of the developing roller 24.

The developing blade 25 contacts the developing roller 24 to optimize an amount of the toner on the developer carrying member and a toner electric charge. The developer carrying member is formed with a thin plate-like member and is deformed by entering the developing roller 24, thus contacting the developing roller 24 at a contact pressure by a repelling force of the deformation.

(Developer Accommodating Unit)

The toner t is accommodated in the flexible developer accommodating portion 20 before use of the cartridge and is accommodated in the developing device. The developer accommodating portion 20 is fixed by being accommodated in a frame 27 and being locked at a predetermined position. Then, at the time of the use of the cartridge, the toner t is discharged from the inside of the developer accommodating portion 20 to contact the developing roller 24 and the developer supplying roller 26, thus being used for the image formation.

The above-described developer accommodating portion 20 is provided with a plurality of openings, for permitting discharge of the toner t, sealed with the sealing members 22*a* and 22*b*. Bonding of a bonding portion of the openings through which the developer is to be incorporated may be performed by ultrasonic bonding, laser bonding or bonding using an adhesive agent, a double-side tape or the like.

Figure 3:
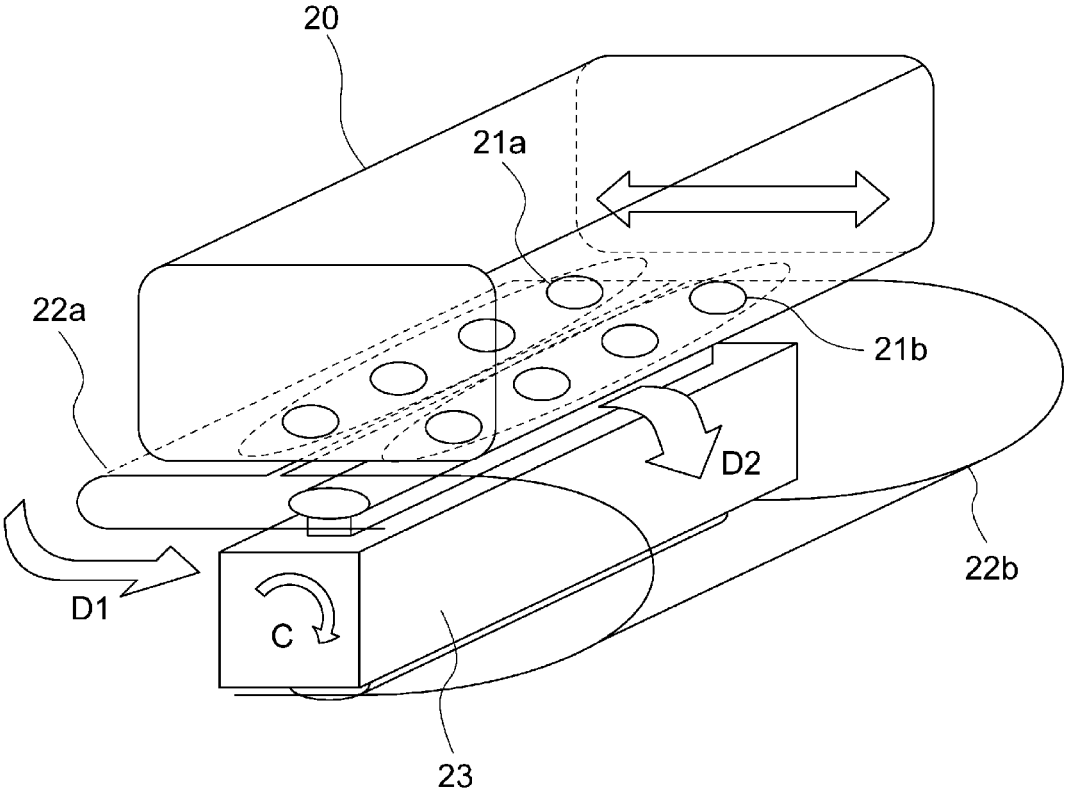
FIG. 3 is a schematic view of an arrangement of openings of a developer accommodating unit.

In this embodiment, as shown in FIG. 3, as the openings for permitting the discharge of the toner t, circular holes are formed in a line along a direction crossing an unsealing direction D. Further, a plurality of arrays of these circular holes, e.g., two arrays in this embodiment are disposed in parallel so as to be shifted from each other in the unsealing direction D. The two arrays include an upstream array of openings 21*a* and a downstream array of openings 21*b* with respect to the rotational direction of the unsealing member 23. Further, each of the openings 21*a* is sealed with a first sealing member 22*a*, and each of the openings 21*b* is sealed with a second sealing member 22*b*.

Each of the sealing members 22*a* and 22*b* is a sheet-like member including a sealing portion for covering associated openings 21*a* or 21*b*, an engaged portion fixed on the unsealing member 23, and a sealing member connecting portion for connecting the sealing portion and the engaged portion. As a material for the sealing members 22*a* and 22*b*, a laminated material having a sealant layer exhibiting an easy-peeling property may appropriately be selected from materials which include a base material such as polyethylene terephthalate (PET), polyethylene or polypropylene and which are 0.03-0.15 mm in thickness.

The unsealing member 23 is a bar-like member having a rectangular shape in cross-section and is rotatably supported at each of longitudinal end portions. One end portion of each of the sealing members 22*a* and 22*b* is locked with the unsealing member 23. For this reason, when the unsealing member 23 rotates in an arrow C direction in FIG. 3, each of the sealing members 22*a* and 22*b* is wound up by the unsealing member 23 and is removed. That is, the sealing member 22*a* is removed by being moved in an arrow D1 direction as a first unsealing direction. Further, the sealing member 22*b* is removed by being moved in an arrow D2 direction as a second unsealing direction. Incidentally, the second unsealing direction is a direction in which unsealing advances toward a side opposite from the first unsealing direction.

(Fold-Back Portion of Sealing Member)

Figure 5:
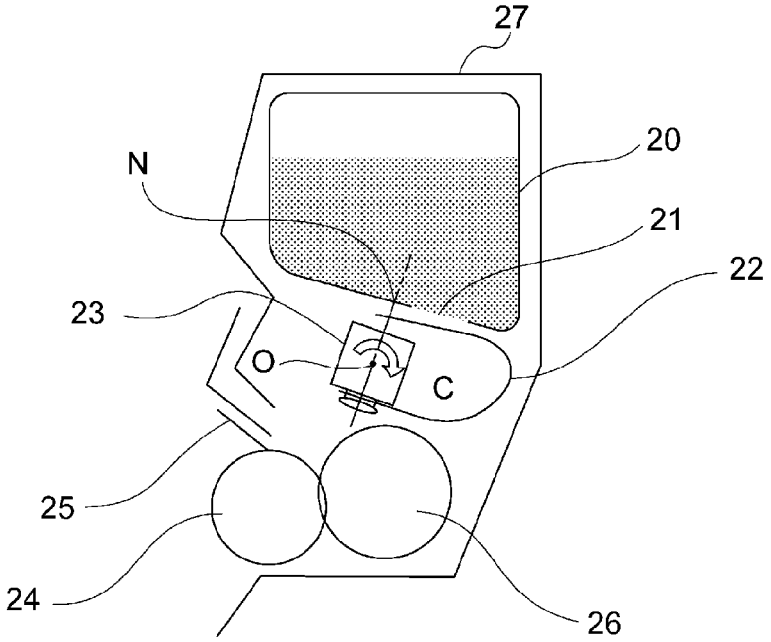
In FIG. 5, (a) and (b) are substantially sectional views of developing devices when openings are provided in a downstream side and an upstream side, respectively, of a rotational direction of an unsealing member.
Figure 5:
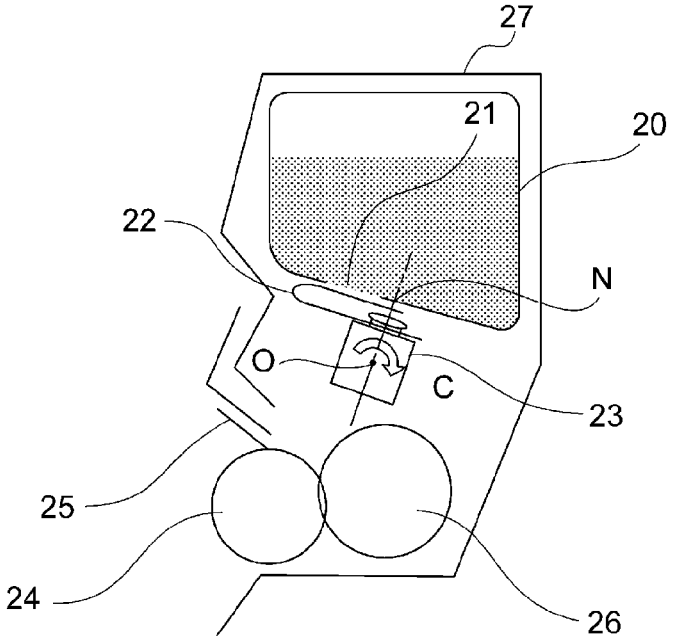

The openings 21*a* and 21*b* described above are disposed in an upstream side and a downstream side, respectively with respect to the rotational direction of the unsealing member 23, of a closest point N (FIG. 5) of the developer accommodating portion 20 to the rotation shaft of the unsealing member 23. Then, each of the sealing members 22*a* and 22*b* is provided with a fold-back portion so as to be removed from a side, remote from the closest point N, toward the closest point N by rotation of the unsealing member 23.

This is because there is a constraint such that it is difficult for the sealing member 22*a* disposed in the upstream side of the rotational direction of the unsealing member 23 to unseal the openings 21*b* and it is difficult for the sealing member 22*b* disposed in the downstream side of the rotational direction of the unsealing member 23 to unseal the openings 21*a*. The reasons therefor will be described below.

Figure 4:
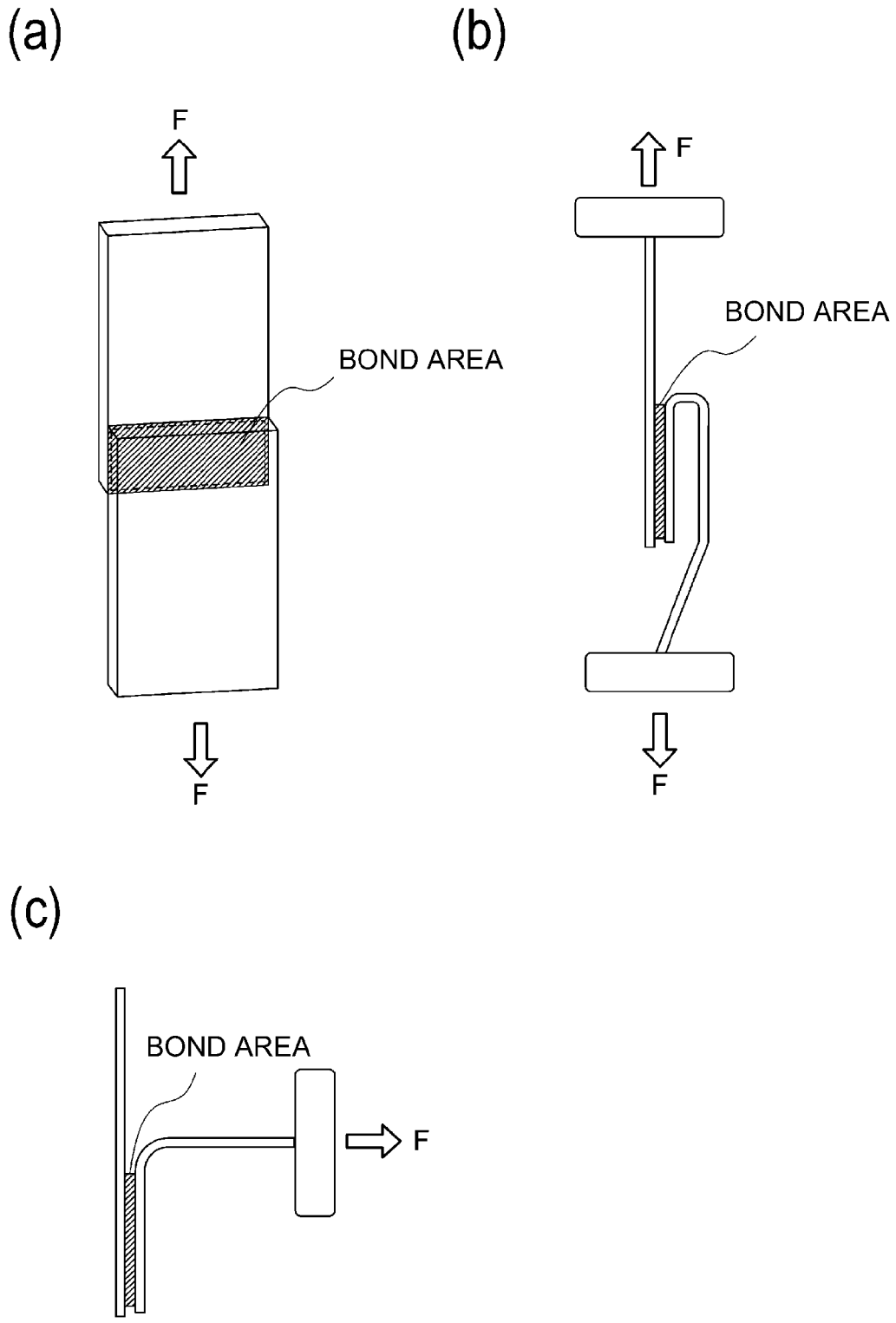
In FIG. 4, (a) to (c) are schematic views for illustrating stretching shearing peeling, 180-degree peeling and 90-degree peeling, respectively.

The developer accommodating portion 20 and the unsealing member 23 are bonded, and therefore it is known that a force necessary to peel out these members from each other largely varies depending on a type of peeling. Here, FIG. 4 are schematic views showing various types of peeling. In FIG. 4, (a) shows stretching shearing peeling, (b) shows approximately 180-degree peeling in which the sealing member is removed by being folded back by approximately 180 degrees, and (c) shows approximately 90-degree peeling in which the sealing member is removed by being folded back for approximately 90 degrees. In either of the peeling types, stress is applied in an arrow F direction to peel off an adhesive area (adhesive surface).

In general, stress necessary to peel off the sealing member in the stretching shearing peeling is not less than 10 times stress necessary to peel off the sealing member in the 180-degree peeling or the 90-degree peeling in many cases. For this reason, when the sealing member is peeled off at the time of initial use of the cartridge, in a state of the stretching shearing peeling, compared with other peeling types, a very large force is needed.

In such a case, there is a fear that a user cannot pull the sealing member or that the sealing member is torn halfway. Further, when an adhesive force is weaken by employing an adhesive or an adhesive method in which the adhesive force is very weak, there is a fear that the toner is leaked out during transportation. For this reason, in order that the toner is not leaked out and that the sealing member can easily be peeled off, there is a need to employ a constitution in which the sealing member is peeled off from the developer accommodating portion in such a state of the 180-degree peeling or the 90-degree peeling.

Here, the cases where the sealing member is disposed in the downstream side and the upstream side of the rotational direction of the unsealing member will be described specifically.

First, the case where the sealing member 22 is disposed in the downstream side, with respect to the rotational direction of the unsealing member 23, of the closest point N of the developer accommodating portion 20 to the rotation shaft of the unsealing member 23 will be described. This is the case where as shown in (a) of FIG. 5, the sealing member 22 is disposed in the downstream side (right side of a broken line), with respect to the rotational direction, of a perpendicular line (illustrated as the broken line) drawn from a rotation center O of the unsealing member 23 toward the sealing member 22.

When the opening 21 is positioned in the downstream side (right side) of the broken line with respect to the rotational direction, the sealing member 22 is subjected to the 90-degree peeling in which an angle of the fold-back portion of the sealing member 22 is 90 degree or less, and therefore is capable of being easily peeled off. On the other hand, when the opening 21 is positioned in the upstream side (left side) of the broken line with respect to the rotational direction, the angle of the fold-back portion is larger than 90 degrees, so that a force acting between the sealing member 22 and the opening 21 is directed only in a shearing direction. For this reason, it is difficult to peel off the sealing member 22.

Therefore, in the case where the sealing member 22 is disposed in the downstream side (right side) of the broken line with respect to the rotational direction of the unsealing member 23, in order to easily unseal the sealing of the opening 21, the opening 21 may preferably be disposed in the downstream side (right side) of the broken line with respect to the rotational direction of the unsealing member 23.

Next, the case where the sealing member 22 is disposed in the upstream side, with respect to the rotational direction of the unsealing member 23, of the closest point N of the developer accommodating portion 20 to the rotation shaft of the unsealing member 23 will be described. This is the case where as shown in (b) of FIG. 5, the sealing member 22 is disposed in the upstream side (left side of a broken line), with respect to the rotational direction, of a perpendicular line (illustrated as the broken line) drawn from the rotation center O of the unsealing member 23 toward the sealing member 22.

At this time, the sealing member 22 is in a state in which the sealing member 22 is folded back by approximately 180 degrees. That is, when the opening 21 is positioned in the upstream side (left side) of the broken line with respect to the rotational direction of the unsealing member 23, the sealing member 22 is subjected to the 180-degree peeling in a state in which an angle of the fold-back portion of the sealing member 22 is very small, and therefore is capable of being easily peeled off. On the other hand, when the opening 21 is positioned in the downstream side (right side) of the broken line with respect to the rotational direction, a force acting between the sealing member 22 and the opening 21 is principally directed in a shearing direction, and therefore, it is difficult to peel off the sealing member 22.

Therefore, in the case where the sealing member 22 is disposed in the upstream side (left side) of the broken line with respect to the rotational direction of the unsealing member 23, in order to easily unseal the sealing of the opening 21, the opening 21 may preferably be disposed in the upstream side (left side) of the broken line with respect to the rotational direction of the unsealing member 23.

As described above, in the case where the plurality of the arrays of the openings 21*a* and 21*b* are provided in order to increase an opening portion, it is preferable that at least one array of openings is disposed in each of the upstream and downstream sides of the rotational direction of the unsealing member 23 and is sealed with the associated one of the sealing members 22*a* and 22*b*. As a result, in the case where each of the sealing members 22*a* and 22*b* is wound up by the unsealing member 23, the sealing member can be wound up in a state in which the angle of the associated fold-back portion is 90 degrees or less, so that it is possible to improve an unsealing property by decreasing an unsealing load.

Incidentally, in this embodiment, each of the array of the circular openings 21*a* and the array of the circular openings 21*b* is disposed in line. When a discharging property is taken into consideration, a shape of the opening portion may preferably be large. Further, the connecting portion between the circular openings may desirably be large from the viewpoint of enhancing strength of the developer accommodating portion 20. Therefore, an area of each of the openings and the connecting portion is required to achieve a balance based on a material of the openings, a thickness and a force relationship with a peeling strength during unsealing, and therefore may be appropriately selected. Further, also a shape of the openings may be shapes, other than the circular shape, such as a polygonal shape (e.g., a rectangular shape) or an elongated circular shape. Further, in the above-described embodiment, the two arrays of the openings are provided, but three or more arrays of the openings may also be provided.

Second Embodiment

Next, a developer accommodating unit according to Second Embodiment will be described. Incidentally, a basic constitution of the developer accommodating unit in this embodiment is identical to that in First Embodiment described above, and is omitted from redundant description and herein will be described with respect to a characteristic constitution of this embodiment. Further, members having the same functions as those in First Embodiment are represented by the same reference numerals or symbols.

In the developer accommodating unit in this embodiment, with respect to the developer accommodating unit described in First Embodiment, a length or the like of the connecting portion for the plurality of the openings 21*a* and 21*b* is adjusted to shift timing when a force required to peel off each of the sealing members 22*a* and 22*b* during unsealing provides a peak.

Figure 6:
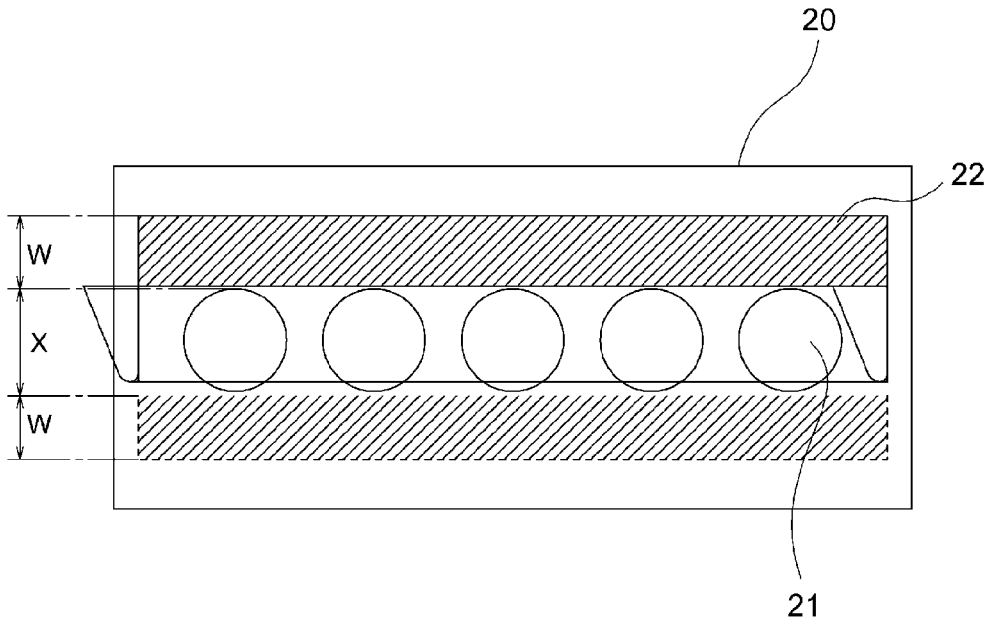
FIG. 6 is a schematic view showing a relationship between the openings and an adhesive portion (bonding portion) of a sealing member.

The sealing member 22 for sealing the openings 21 shown in FIG. 6 is needed to cover all the openings 21 so as to prevent toner leakage-out through the openings 21. For that reason, with respect to a widthwise (short) direction of the openings 21 which is the same direction as the unsealing direction of the sealing member 22, there is a region W (indicated by a hatched line in FIG. 6) in which all the entire longitudinal area of the openings provided in the upstream side and the downstream side of the unsealing direction is bonded.

For this reason, the rotation shaft of the unsealing member is driven, and progression of a torque from start to end of the peeling of the sealing member 22 is such that a peak appears at each of an unsealing initial stage, in which the whole of the longitudinal area of the openings 21 arranged in a direction perpendicular to the unsealing direction is bonded, and a point just before the end of the unsealing. This is because in the region W where the entire longitudinal area is bonded, a bonded (planar) area is large compared with a region X where the openings 21 are disposed, and therefore a larger force is required for peeling off the sealing member 22.

For this reason, as described in First Embodiment, assuming that the plurality of the arrays of the openings 21*a* and 21*b* consisting of the circular holes arranged in line and are sealed with the sealing members 22*a* and 22*b*, respectively, when timing of a torque peak during the removal of the sealing member 22*a* coincides with that during the removal of the sealing member 22*b*, a larger torque is needed to peel off the sealing members 22*a* and 22*b*. For that purpose, there is a need to provide a rotation shaft having a larger strength or a motor capable of generating a larger torque. Further, in the case where a constitution in which the user performs unsealing of the process cartridge during start of the use is employed, the larger torque is needed, so that a burden is imposed on the user.

Incidentally, of the plurality of the sealing members 22*a* and 22*b*, after the removal of one sealing member 22*a* is completely ended, the removal of the other sealing member 22*b* may be started, but in that case, it takes much time from start to end of the removal of the sealing members 22*a* and 22*b*.

Therefore, in this embodiment, the length or the like of the connecting portion for the plurality of the sealing members 22*a* and 22*b* is adjusted, so that timing of a peak of a force exerted on the unsealing member 23 during the peeling of each of the sealing members 22*a* and 22*b* is shifted from each other to reduce the torque needed to removal the sealing members 22*a* and 22*b*.

Figure 7:
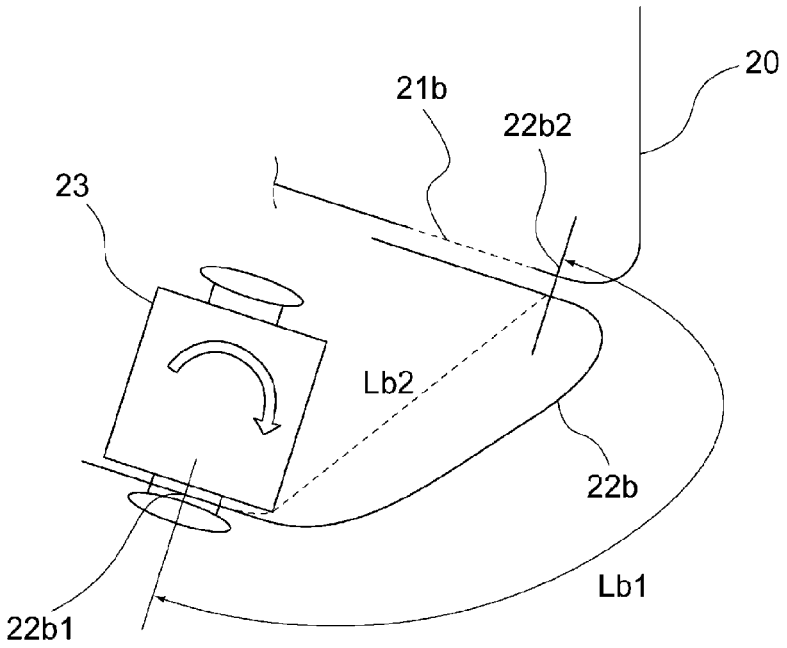
FIG. 7 is a schematic view showing a length of the sealing member and a distance between the unsealing member and the opening.

Here, during the unsealing, a speed of movement of an engaging portion of the unsealing member 23 with the sealing member is taken as V. Further, as shown in FIG. 7, a length from an engaged portion 22*b*1 of the sealing member 22*b* to a sealing portion of a bonding portion 22*b*2 of the opening 21*b* is taken as Lb1, and a length from an engaging portion of the unsealing member 23 before the drive to the unsealing member 22*b* is taken as Lb2. A slack portion of the sealing member 22*b* is Lb1−Lb2, so that a time Tb from start of rotation of the unsealing member 23 to peeling off of the sealing member 22*b* from the openings 21*b* is represented by Tb=(Lb1−Lb2)/V. Incidentally, the slack portion is set so that removal of at least one of the sealing members 22*a* and 22*b* is started during one full turn of the unsealing member 23.

Similarly, a length from an engaged portion of the sealing member 22*a* to a sealing portion is taken as La1, and a length from an engaging portion of the unsealing member 23 before the drive to the unsealing member 22*a* is taken as La2. A slack portion of the sealing member 22*a* is La1−La2, so that a time Tb from start of rotation of the unsealing member 23 to peeling off of the sealing member 22*a* from the openings 21*a* is represented by Ta=(La1−La2)/V.

That is, a difference ΔT in unsealing start time between the sealing members 22*a* and 22*b* can be represented by ΔT=|Ta−Tb|.

Further, as shown in FIG. 6, a width, with respect to the rotational direction, in which the sealing member 22 bonds the entire longitudinal area in each of the upstream side and the downstream side of the openings 21 is taken as W, and a width of the openings 21 with respect to the rotational direction is taken as X. When peeling off of the sealing member is started, the torque peak appears at timing between zero to W/V and at timing between (W+X)/V to (2W+X)/V, and a minimum torque appears at timing of (W+0.5X)/V.

That is, it is desirable that the difference ΔT in unsealing start time between the sealing members 22*a* and 22*b* is absent between zero to W/V and between (W+X)/V to (2W+X)/V, and the difference Δ may most desirably appear at the timing of (W+0.5X)/V when the minimum torque appears.

Figure 8:
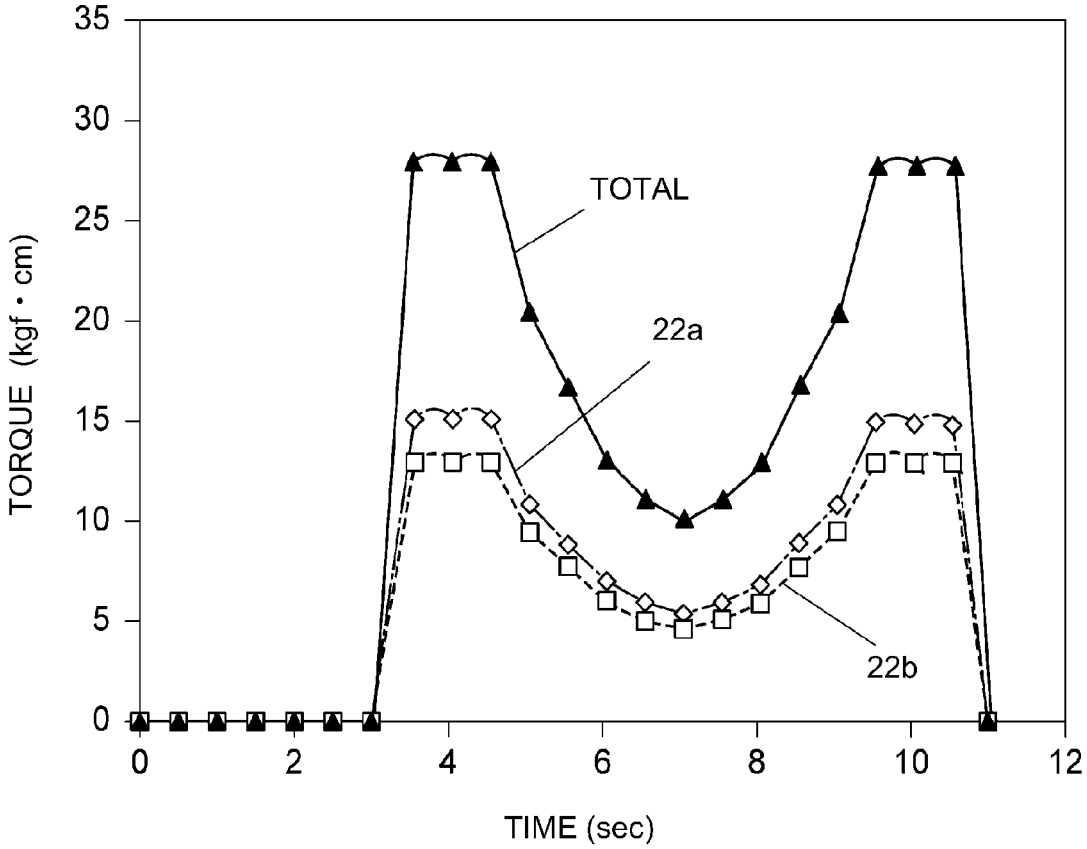
FIG. 8 is a graph showing a time progression of a torque in the case where peaks of forces coincide in time with each other.
Figure 9:
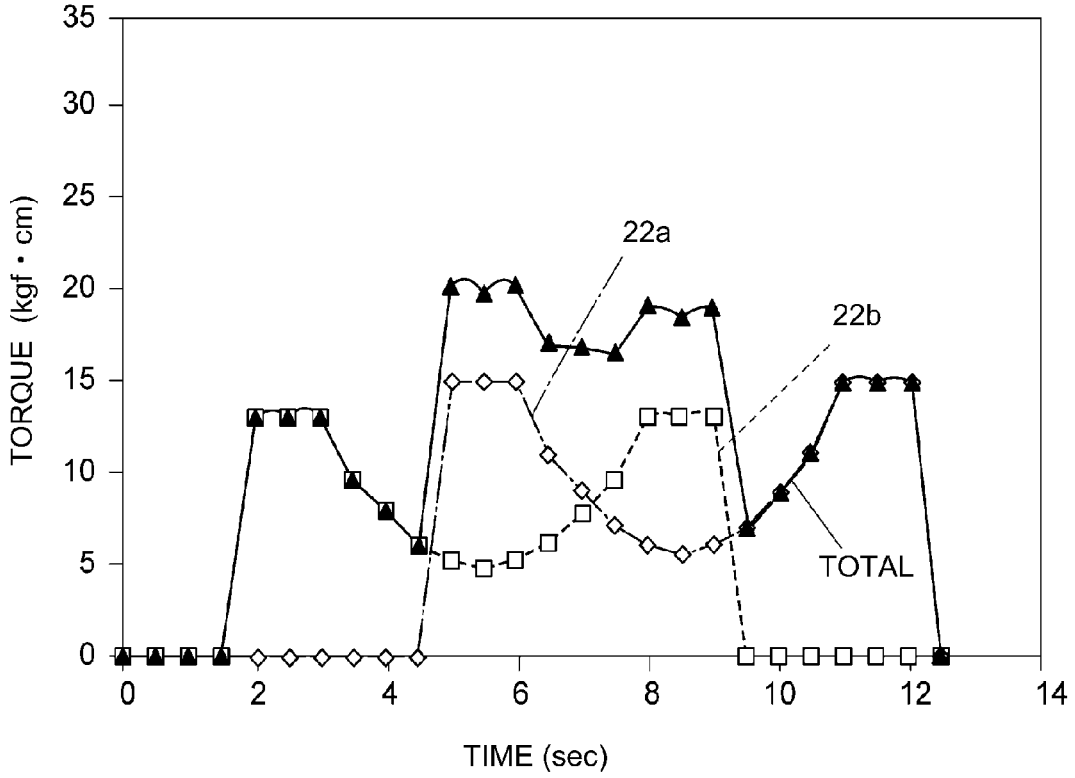
FIG. 9 is a graph showing a time progression of a torque in the case where peaks of forces are shifted from each other.

Here, a progression of a total torque of the respective torques in the case where the unsealing start time of the sealing member 22*a* and the unsealing start time of the sealing member 22*b* are same is shown in FIG. 8. Further, a progression of a total torque of the respective torques when the difference ΔT in unsealing start time between the sealing members 22*a* and 22*b* appears at the timing of (W+0.5X)/V when the torque of the unsealing member 23 becomes minimum is shown in FIG. 9. As shown in FIG. 9, compared with the case where the torque peaks appear at the same timing, a value of the peak of the total torque can be effectively reduced. That is, by providing a time difference between the unsealing in the first unsealing direction and the unsealing in the second unsealing direction, the peak value of the sum of the respective unsealing torques can be decreased.

As described above, the respective openings 21*a* and 21*b* are bonded and sealed at a periphery thereof by the sealing members 22*a* and 22*b*, respectively. Then, the plurality of the openings 21*a* and 21*b* are unsealed (exposed) by rotation of the unsealing member 23. At this time, a constitution such that the peeling-off of the bonding portion (adhesive portion) at the first openings 21*a* with respect to a direction crossing the unsealing direction of the sealing member 22*a* and the peeling-off of the bonding portion at the second openings 21*b* with respect to the direction crossing the unsealing direction of the sealing member 22*b* are performed in a shift manner is employed. As a result, also when the plurality of the sealing members 22*a* and 22*b* are peeled off, an increase in total torque can be suppressed. At the same time, it is possible to remove all the sealing members 22*a* and 22*b* without taking much time.

Third Embodiment

Figure 10:
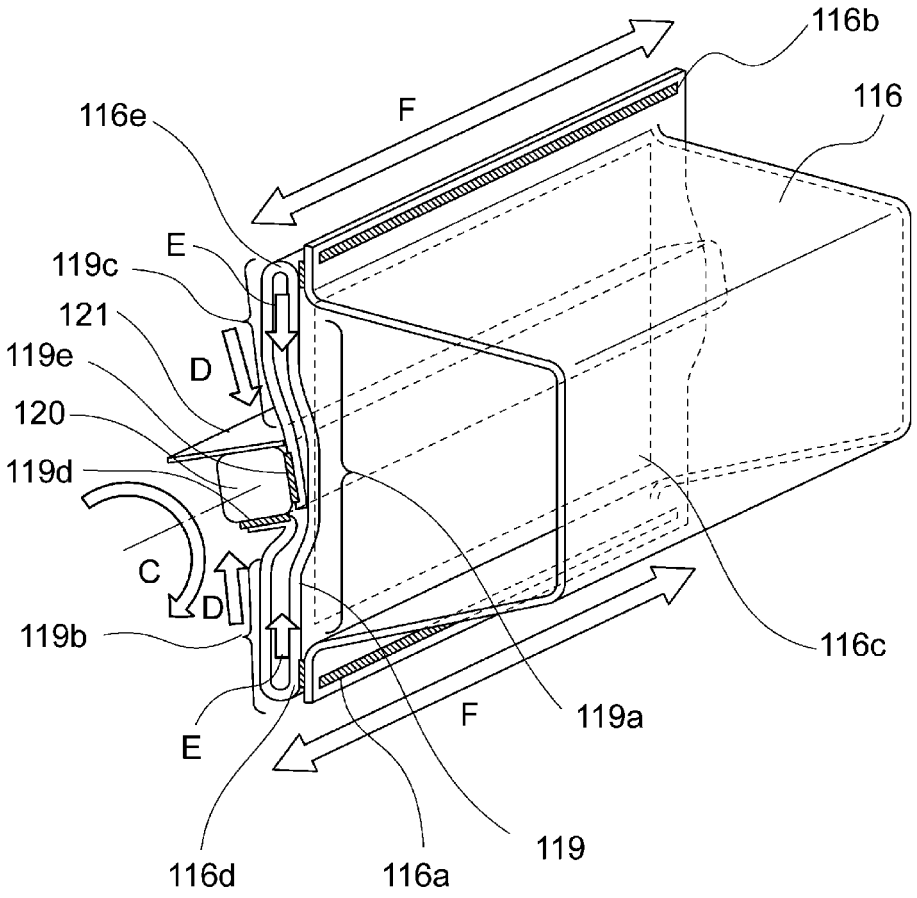
FIG. 10 is a perspective view of a developer accommodating container including an unsealing member in Third Embodiment.
Figure 11:
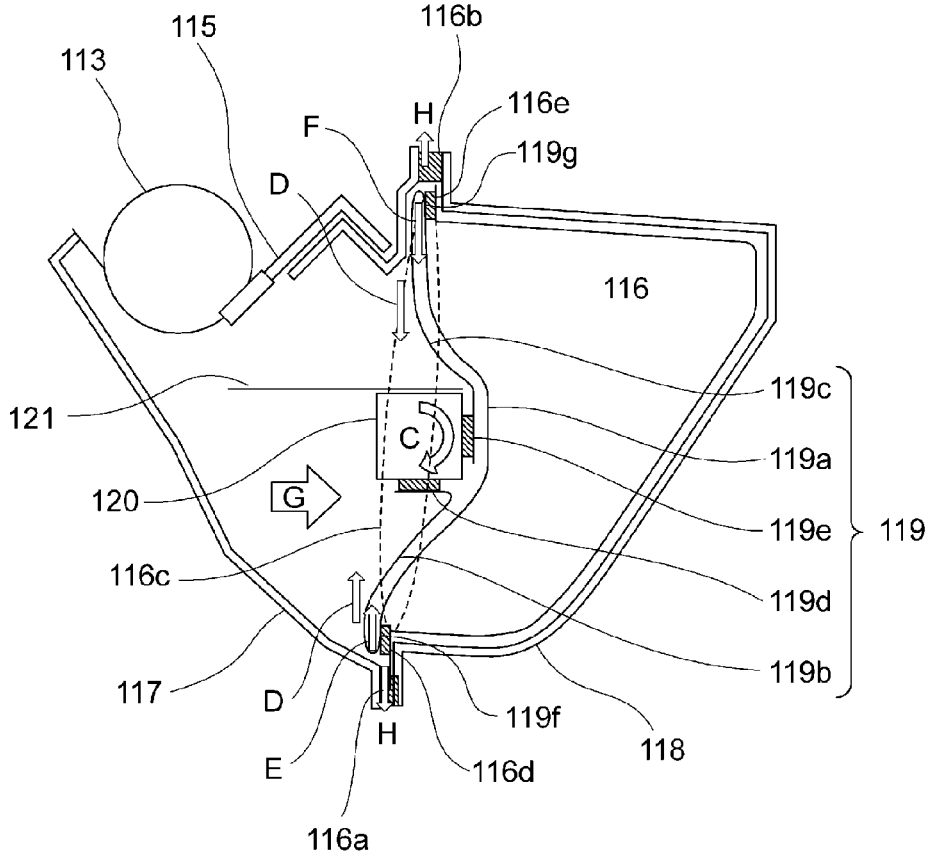
FIG. 11 is a sectional view of a developer accommodating unit before unsealing in Third Embodiment.

Next, a developing device including a developer accommodating unit according to Third Embodiment will be described. FIG. 10 is a perspective view of the developer accommodating unit in this embodiment, and FIG. 11 is a sectional view of the developing device including the developer accommodating unit. Further, FIG. 12 is a schematic view of the developing device as seen from an arrow G direction of FIG. 11, and is a sectional view of the developing device immediately after the unsealing is started.

The developing device in this embodiment includes a first frame 117 and a second frame 118 as shown in FIG. 11. Further, the first frame 117 includes a developing roller 113 as a developing means and a developing blade 115, and the second frame 118 includes a developer accommodating portion 116 formed with a flexible container for accommodating therein the toner as the developer.

As shown in FIGS. 10 and 11, the developer accommodating portion 116 which is constituted by the flexible container and which accommodates the toner includes a first fixing portion 116*a* with the second frame 118 and a second fixing portion with the first frame 117 and is provided with an opening 116*c* for permitting discharge of the toner accommodated therein. The opening 116*c* in this embodiment is, as shown in FIG. 12, constituted by a single large rectangular opening. After the developer is accommodated, the opening 116*c* is sealed by being covered with a sealing member 119 and being bonded at a periphery thereof. Further, the sealing member 119 is locked with an unsealing member 120 at an end portion thereof while being folded back at the bonding portion. Further, the opening 116*c* is formed so as to be positioned at a closest point of the developer accommodating portion 116 to a rotation shaft of the unsealing member 120. Incidentally, in this embodiment, the unsealing member 120 is disposed so that a rotation center thereof is positioned at a substantially central portion of the opening 116*c*.

Figure 12:
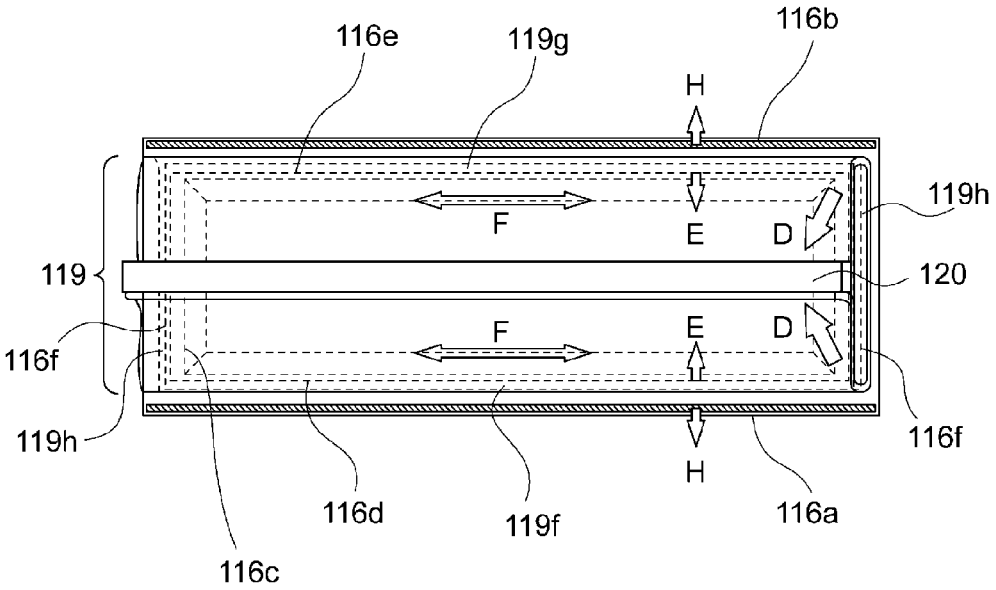
FIG. 12 is an illustration of a sealing portion in Third Embodiment.
Figure 13:
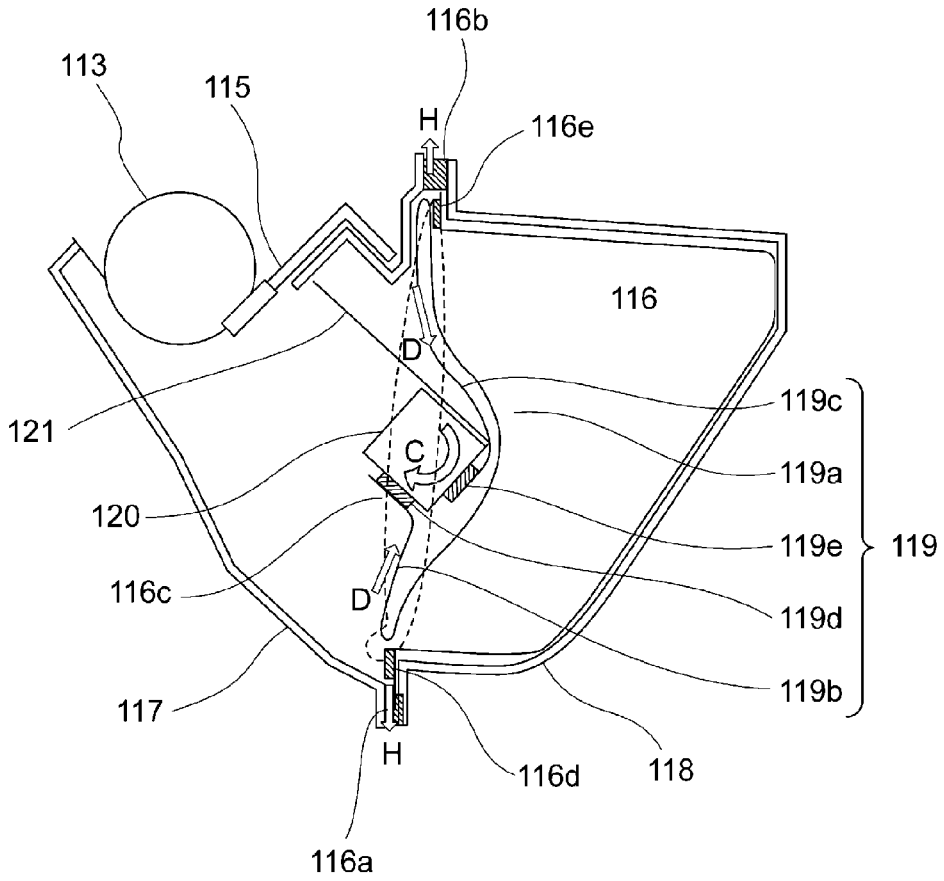
FIG. 13 is a sectional view of the developer accommodating unit before start of the unsealing in Third Embodiment.

A sealing portion by the sealing member 119 includes, as shown in FIG. 12, a first sealing portion 119*f* and a second sealing portion 119*g* each extending in a direction F substantially perpendicular to an unsealing (advance) direction E and includes a third sealing portion 119*h* extending the unsealing direction E so as to form a continuous closed sealing portion. The developer accommodating portion 116 is provided with a first bonding portion 116*d* bonded to the first sealing portion 119*f*, a second bonding portion 116*e* bonded to the second sealing portion 119*g*, and a third bonding portion 116*f* bonded to the third sealing portion 119*h*. These sealing portions and the bonding portions are bonded by, e.g., welding in which a part of the sealing portions is welded or by bonding using an adhesive or the like. Further, the unsealing direction E (first unsealing direction and second unsealing direction) in the case of unsealing the sealing member advances in parallel with a plane in which the opening 116*c* is provided. For this reason, when the unsealing member 120 is rotated to peel the sealing member 119, as shown in FIG. 13, the sealing member 119 is peeled from the first bonding portion 116*d* and the second bonding portion 116*e* of the developer accommodating portion 116 to start the unsealing (removal) thereof. That is, for the unsealing, the first bonding portion 116*d* is located at a first unsealing start position and the second bonding portion 116*e* is located at a second unsealing start position.

The sealing member 119 includes, as shown in FIG. 11, a sealing portion 119*a* for covering the opening 116*c*, a first fixing portion (mounting portion) 119*d* and a second fixing portion (mounting portion) 119*e*, where the sealing member 119 is locked and fixed on the sealing member 120. Further, the sealing member 19 includes a connecting portion (first connecting portion) 119*b* for connecting the sealing portion 119*a* and the first fixing portion 119*d* and a connecting portion (second connecting portion) 119*c* for connecting the sealing portion 119*a* and the second fixing portion 119*e*.

The toner is accommodated in the developer accommodating portion 116, and then the developer accommodating portion 116 sealed with the sealing member 119 at the opening 116*c* thereof is fixed in the second frame 118 at the first fixing portion 116*a* and the second fixing portion 116*b* by locking or the like. Further, the developer accommodating unit is formed by connecting the first frame 117 and the second frame 118. Further, the unsealing member 120 is provided rotatably inside a device main body of the developing device.

In order to realize the unsealing by the above-described constitution, there is a need to always peel off the first sealing portion 119*f* and the second sealing portion 119*e* at the start. That is, with the rotation of the unsealing member 120, there is a need to peel off the first sealing portion 119*f* from the first bonding portion 116*d* by pulling of the first connecting portion 119*b* and to peel off the second sealing portion 119*g* from the second bonding portion 116*e* by pulling of the second connecting portion 119*c*. Therefore it is essential that at all of bonding portions of the developer accommodating portion 116, strength, i.e., a peeling force of each bonding portion between the sealing member 119 and the developer accommodating portion 116 is weakest. This is true for other portions. With respect to a fixing force between the sealing member 119 and the unsealing member 120, a fixing force between the developer accommodating portion 116 and the second frame 118, or the like force, it is essential that the above-described peeling force is weakest.

On the other hand, the developer accommodating unit functionally accommodates the toner therein, and therefore from the viewpoint of a sealing property, a larger peeling force to the possible extent is advantageous. This is because when the peeling force is large, there is a high possibility that a status in which the openings are unsealed in a state other than an intended state (in which the developer accommodating unit is set in the image forming apparatus) in the case where an unexpected force (e.g., an impact force during drop) can be avoided. From the above, the peeling force is required to be controlled and set at a desired value.

A method of controlling the peeling force at the desired value will be described. In this embodiment, in order to set the peeling force at the desired value (a minimum force within a range in which the toner sealing property can be maintained), two methods are principally employed.

In a first method, as the sealing member 119, a laminate material having a special sealant layer which exhibits an easy peeling property (peeling strength of about 3N/15 mm in testing methods for heat sealed flexible packages according to JIS-Z0238) is applied. Further, the first method is a method in which the easy peeling property is exhibited at the peeling portion by using, as the material (member) for the developer accommodating portion 116, a sheet material (of, e.g., polyethylene or polypropylene) which is weldable with the special sealant layer and which has flexibility. By changing a combination of formulation of the special sealant layer with the material to be bonded, the peeling force can be reduced.

A second method is a method in which as shown in FIGS. 11 and 12, the opening 116*c* of the developer accommodating portion 116 is placed in a state in which the sealing member 119 is folded back with respect to the unsealing direction (arrow E direction in the figures). Further, the first bonding portion 116*d* as the first unsealing start position is disposed between the first fixing portion 116*a* and the unsealing member 120, and the second bonding portion 116*e* as the second unsealing start position is disposed between the second fixing portion 116*b* and the unsealing member 120. That is, as shown in FIG. 11, in the case where the first bonding portion 116*d* and the second bonding portion 116*e* are disposed along a direction of gravitation, the unsealing member 120 is disposed between the first bonding portion 116*d* and the second bonding portion 116*e* with respect to the direction of gravitation.

As a result, when the unsealing member 120 is rotated in the arrow C direction in FIG. 11, the sealing member 119 is pulled in the arrow D direction. Here, the developer accommodating portion 116 is fixed in the frame by the first fixing portion 116*a* and the second fixing portion 116*b*. For this reason, a force is applied to the first bonding portion 116*d* and the second bonding portion 116*e* each in an arrow H direction, so that the removal of the sealing portions 119*f* and 119*g* is started. At this time, the developer accommodating portion 116 and the unsealing member 119 provide the fold-back portion with an angle of 90 degrees or less as shown in FIG. 11, thus establishing a positional relationship of inclination peeling. In this way, by placing the sealing member 119 in the fold-back state with respect to the unsealing (advance) direction (arrow E direction in the figure), it is possible to decrease the peeling force.

Figure 14:
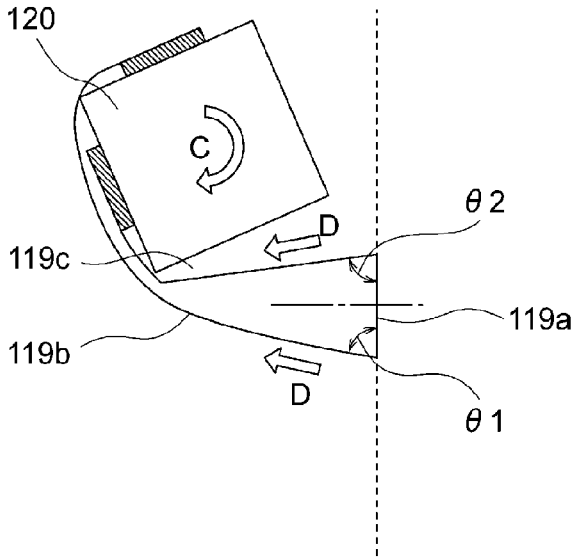
FIG. 14 is a sectional view of the developer accommodating unit in an unsealed state in Third Embodiment.

Particularly, in the peeling state at a terminal stage of the unsealing, as shown in FIG. 14, both of an angle θ1 formed between the sealing portion and the first connecting portion 119*b* of the sealing member 119 and an angle θ2 formed between the sealing portion and the second connecting portion 119*c* of the sealing member 119 can be kept in a positional relationship of 90 degrees or less, and therefore the peeling force can be decreased until the unsealing is ended.

Incidentally, the unsealing member 120 is a shaft having a rectangular shape in cross-section and on which a stirring member 121 is fixed at one side thereof, and also functions as a feeding means for feeding the developer (toner) toward the developing roller 113, in addition to a means for stirring the toner discharged from the developer accommodating portion 116. Then, when the unsealing member 120 is further rotated after the unsealing, the sealing member 119 is rotated together with the stirring member 121. The length of the sealing member 119 is set so as not to be wound around the unsealing member 120, so that a toner stirring function of the stirring member 121 is ensured. Here, the stirring member 121 has elasticity and is set so that the stirring member 121 is smaller than the opening 116*c* of the developer accommodating portion 116 during the rotation of the unsealing member 120, and therefore pushes the toner accommodated in the developer accommodating portion 116. For that reason, the toner positioned inside the developer accommodating portion 116 is pushed out by the stirring member 121, so that the toner is discharged through the opening 116*c*.

As described above, in this embodiment, only by rotating the unsealing member 120, it becomes possible to remove the sealing member 119 corresponding to the large opening, so that it is possible to realize stable unsealing of the developer accommodating portion 116 and toner discharge with reliability. Further, it is possible to remove the sealing member 119 by pulling the sealing member 119 in the widthwise direction of the opening 119*c*, and therefore a peeling distance can be remarkably shortened and thus it becomes possible to shorten a lead time to toner supply.

Further, the sealing member 119 after being removed is fixed on the unsealing member 120, so that it is possible to perform the unsealing without generating a discarded material from the process cartridge. Further, by the stirring member 121, also the discharge of the toner from the inside of the developer accommodating portion 116 is performed with reliability.

Further, the sealing member 119 can be moved together with the unsealing member 120, and therefore a toner stirring effect in the process cartridge. Further, the developer accommodating portion 116 is in the form of the flexible container and thus the toner can be treated as a part of a unit, and therefore a toner filling step can be separated from a process cartridge assembling step, so that it is possible to reduce a degree of toner scattering in the assembling step in which a clean environment is required.

Incidentally, it is desirable that the unsealing member 120 has a winding-up constitution of the sealing member 119 by rotation thereof since a large space is not required, but the sealing member 119 can also be removed by moving the unsealing member 120 in a spacing direction from the opening 116*c*.

Fourth Embodiment

Figure 15:
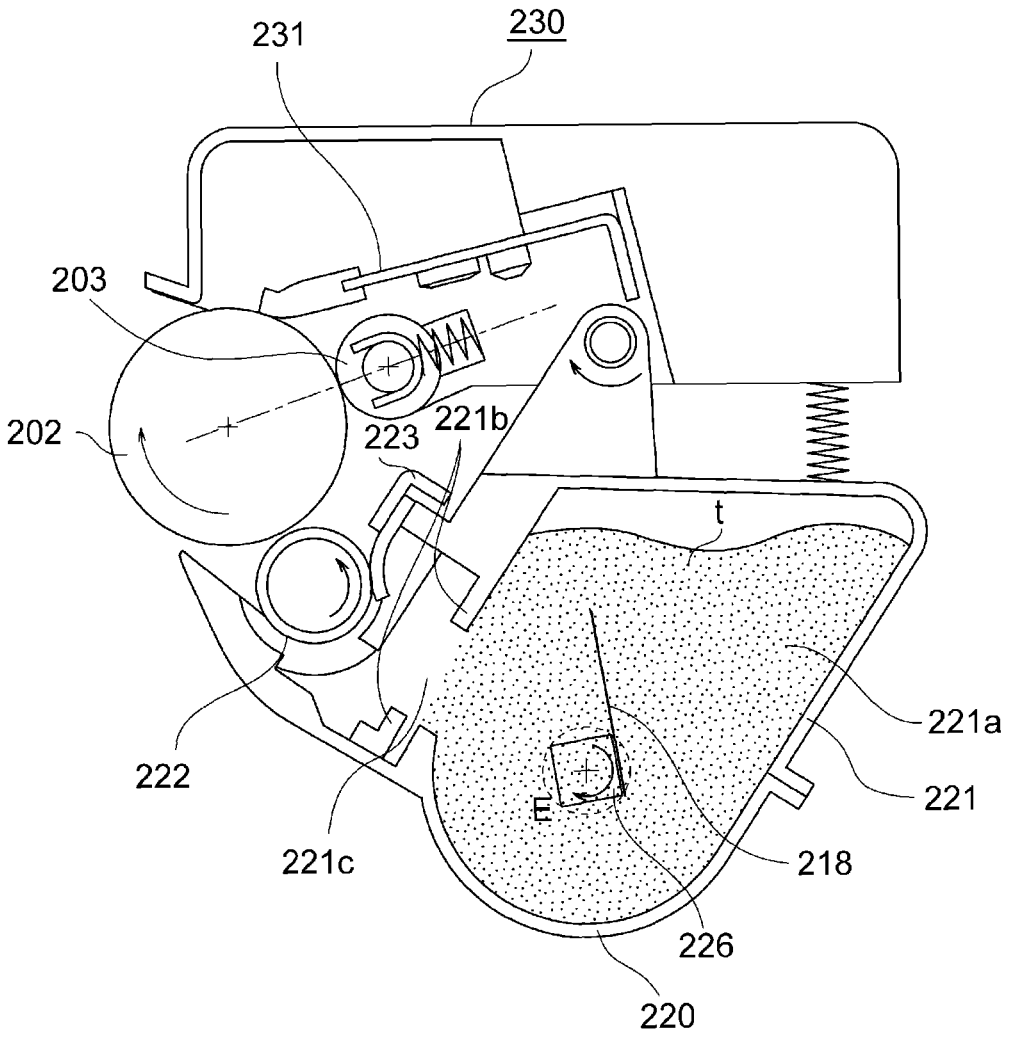
FIG. 15 is a schematic illustration showing a structure of a process cartridge in Fourth Embodiment.

A developer accommodating unit according to Fourth Embodiment will be described. FIG. 15 is a sectional view of a process cartridge including the developer accommodating unit in this embodiment.

The process cartridge in this embodiment is divided into a photosensitive member unit 230 including a photosensitive drum 202, a charging roller 203 and a cleaning member 231, and a developing unit 220 including a developing roller 222. The developing unit 220 constitutes a developing device and is integrally constituted by the developer accommodating unit accommodating the toner and a developing chamber in which the developing roller 222 and a developing blade 223. An image forming process for forming an image by using the process cartridge constituted by the developing unit 220 and the photosensitive member unit 230 is the same as those in the above-described embodiments.

<Developer Accommodating Unit>

Figure 16:
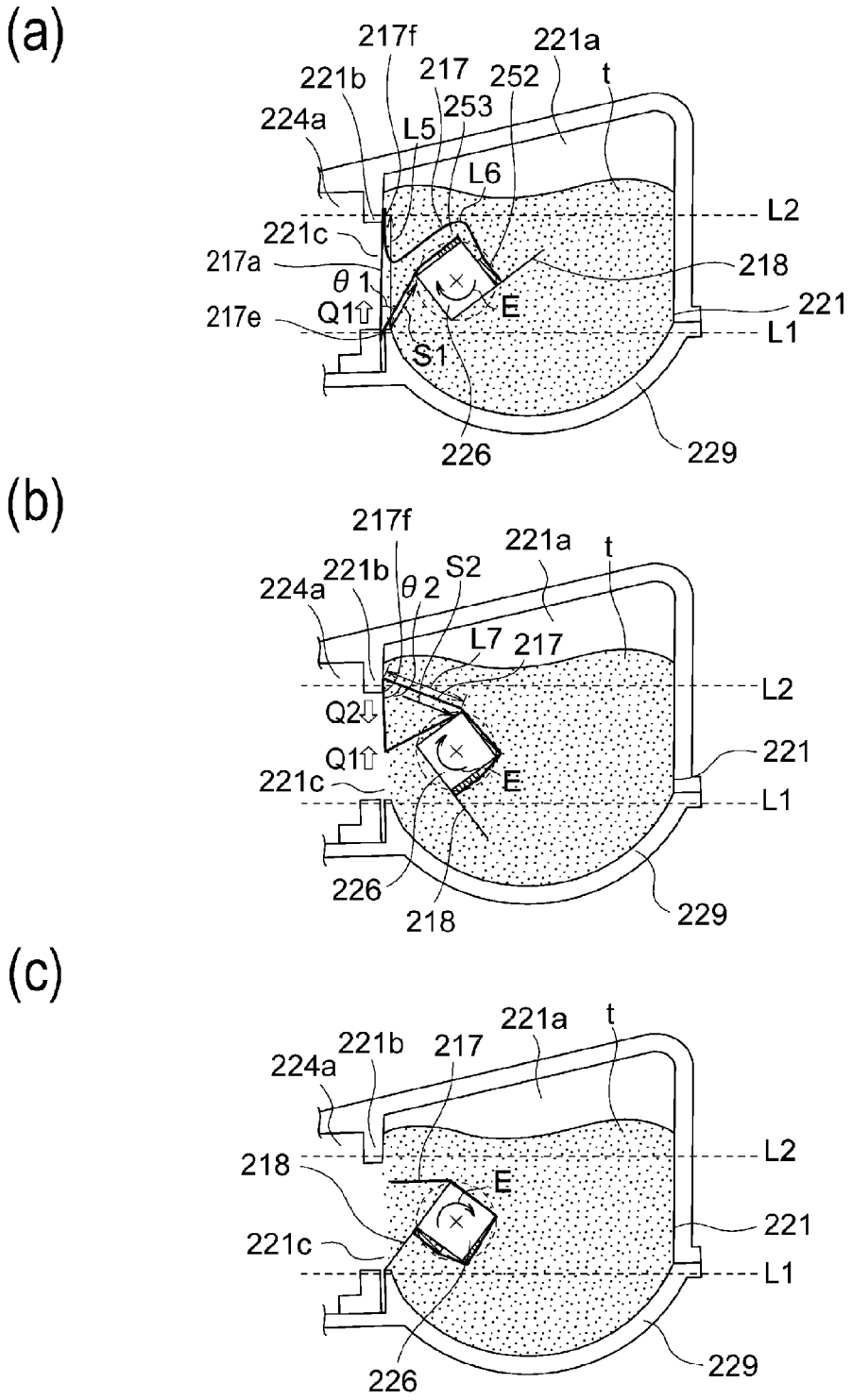
In FIG. 16, (a) to (c) are schematic sectional views each showing a developer accommodating unit in Fourth Embodiment.

Here, the developer accommodating unit in this embodiment will be described. In FIG. 16, (a) to (c) are schematic sectional views each showing the developer accommodating unit in this embodiment, and FIG. 17 is a schematic perspective view for illustrating a relationship of an unsealing member, a sealing member and a toner supplying opening.

As shown in FIG. 16, a developer accommodating portion 221*a* is formed integrally with a developing device frame 221. Further, the developer accommodating portion 221*a* includes a toner t and a partition wall portion 221*b* for partitioning the inside of the process cartridge into the developer accommodating portion 221*a* and a developing chamber 224*a*. Further, the developer accommodating portion 221*a* includes a toner supplying opening 221*c* for permitting communication between the developer accommodating portion 221*a* and the developing chamber 224*a*, an unsealing member 226, a sealing member 217 for unsealably sealing the opening 221*c*, and a stirring member 218.

Figure 17:
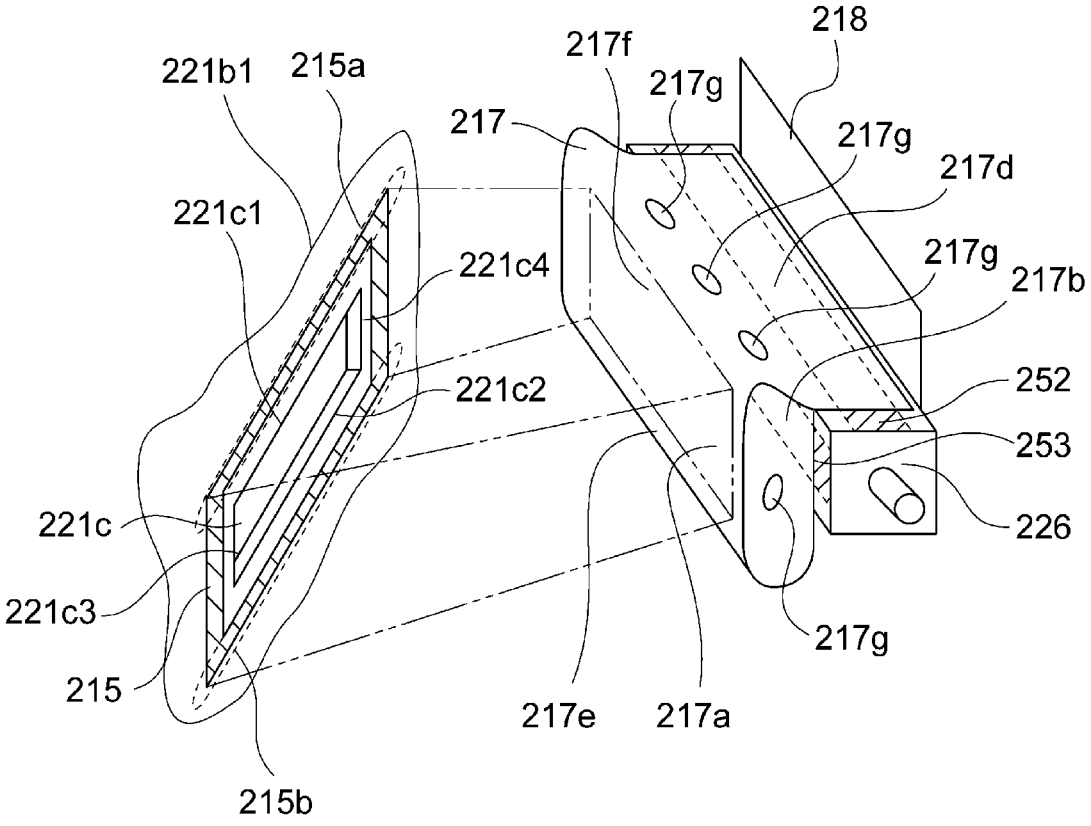
FIG. 17 is a schematic perspective view for illustrating a relationship between an unsealing member, a sealing member and openings in Fourth Embodiment.

The opening 221*c* is, as shown in FIG. 17, formed in a rectangular shape by sides 221*c*1 and 221*c*2 substantially parallel to a longitudinal direction of the developing unit 220 and sides 221*c*3 and 221*c*4 substantially perpendicular to the longitudinal direction of the developing unit 220. However, the shape of the opening 221*c* is not limited to the rectangular shape, but may also be an elliptical shape, a polygonal shape and the like.

Here, as shown in FIG. 17, the stirring member 218 is formed of a flexible material such as PET, PC or PP, and is fixed on the unsealing member 226. Fixing between the stirring member 218 and the unsealing member 226 is made by bonding using a solvent, an adhesive or a double-shape tape or by laser welding, (thermal) welding, ultrasonic welding or the like. Further, the stirring member 218 may also be formed integrally with the unsealing member 226.

(Sealing of Opening)

The sealing member 217 is formed with an easy-peel film capable of cohesive peeling, and includes a sealing portion 217*a*, a first fixing portion 217*b* and a second fixing portion 217*d*.

Further, the sealing portion 217*a* is unsealably mounted with a bonding portion 215 of a pasting portion 221*b*1 provided on the partition wall portion 221*b* so as to surround a full peripheral edge of the opening 221*c*. Here, the bonding portion 215 is formed by bonding, other than the bonding using the solvent or the adhesive, such as the laser welding, the (thermal) welding or the ultrasonic welding. Here, the bonding portion 215 includes a first bonding portion 215*a* and a second bonding portion 215*b*. Further, the sealing portion 217*a* includes a first unsealing start portion 217*e* bonded to the first bonding portion 215*a* at a first unsealing position and a second unsealing start portion 217*f* bonded to the second bonding portion 215*b* at a second unsealing position.

Further, the sealing member 217 is fixed on the unsealing member 226 at the first fixing portion 217*b* and the second fixing portion 217*d*. Here, fixing of each of the first fixing portion 217*b* and the second fixing portion 217*d* with the unsealing member 226 is made by a double-side tape 52, a double-side tape 53, (thermal) welding, caulking, bonding or the like.

(Length of Sealing Member)

Next, a relationship of lengths of the sealing member 217 with respect to a cross-sectional direction will be described.

As shown in FIG. 16, a length of the sealing member 217 from the first unsealing start portion 217*e* to the second unsealing start portion 217*f* taken as L5, and a length of the sealing member 217 from the second unsealing start portion 217*f* to the unsealing member 226 when a force S1 is exerted on the first unsealing start portion 217*e* is taken as L6. Further, a length of the sealing member 217 from the second unsealing start portion 217*f* to the unsealing member 226 when a force S2 is exerted on the second unsealing start portion 217*f* is taken as L7.

Here, during peeling of the sealing member 217 from the first unsealing start portion 217*e*, the peeling of the sealing member 217 is started also from the second unsealing start portion 217*f*, or in order to simultaneously peel the sealing member 217 from the first unsealing start portion 217*e* and the second unsealing start portion 217*f*, a relationship of: $L5>(L6-L7)\geq 0$ is required.

(Arrangement of Unsealing Member)

Next, arrangement of the unsealing member 226 will be described. As shown in FIG. 16, a direction from the first unsealing start portion 217*e* toward the second unsealing start portion 217*f* is taken as an arrow Q1 direction, and an opposite direction to the arrow Q1 direction is taken as an arrow Q2 direction. Further, an angle formed by the arrow Q1 direction and the force S1 exerted on the first unsealing start portion 217*e* during the unsealing is taken as a first peeling angle θ1, and an angle formed by the arrow Q2 direction and the force S2 exerted on the second unsealing start portion 217*f* during the unsealing is taken as a second peeling angle θ2. Here, in order to peel the sealing member 217 from the first unsealing start portion 217*e* and the second unsealing start portion 217*f* by inclination peeling, the unsealing member 226 is disposed at a position where each of the first peeling angle θ1 and the second peeling angle θ2 is 90 degrees or less.

That is, the unsealing member 226 is disposed in the following manner during the unsealing by the rotation of the unsealing member 226. Specifically, the unsealing member 226 is disposed at a position where an angle formed between a line extending from the first unsealing start portion 217*e* and contacting a circumscribed circle c of the unsealing member 226 in a downstream wide of the rotational direction of the unsealing member 226 and a line connecting the first unsealing start portion 216*e* and the second unsealing start portion 217*f* is 90 degrees or less. Incidentally, there are two lines a and b extending from the first unsealing start portion 217*e* and contacting the circumscribed circle c of the unsealing member 226. The line a contacts the circumscribed circle c in an upstream side of the rotational direction of the unsealing member 226, and the line b contacts the circumscribed circle c in the downstream side of the rotational direction of the unsealing member 226. Accordingly, the line extending from the first unsealing start portion 217*e* and contacting the circumscribed circle c of the unsealing member 226 in the downstream side of the rotational direction of the unsealing member 226 means the line b in this case.

Further, the unsealing member 226 is disposed so that an angle formed between a line extending from the second unsealing start portion 217*f* and contacting the circumscribed circle c of the unsealing member 226 in a downstream wide of the rotational direction of the unsealing member 226 and a line connecting the first unsealing start portion 216*e* and the second unsealing start portion 217*f* is 90 degrees or less.

That is, a line perpendicular to the sealing portion 217*a* and passing through the first unsealing start portion 217*e* is taken as L1, and a line perpendicular to the sealing portion 217*a* and passing through the second unsealing start portion 217*f* is taken as L2. In this case, in order that each of the first peeling angle θ1 and the second peeling angle θ2 is 90 degree or less, the unsealing member 226 is disposed between the line L1 and the line L2.

(Assembling Method of Developer Accommodating Unit)

Next, an assembling method of the developer accommodating unit will be described with reference to FIG. 18. As shown in (a) of FIG. 18, the sealing member 217 fixed on the unsealing member 226 at the second fixing portion 217*d* by the double-side tape 252 is fixed on the pasting portion 221*b*1 of the developing device frame 224 with respect to an arrow P1 direction by the (thermal) welding or the ultrasonic welding.

In this case, the sealing member 217 is continuously welded on a peripheral edge of the opening 221*c* to form the bonding portion 215 (a hatched portion in FIG. 17).

Figure 18:
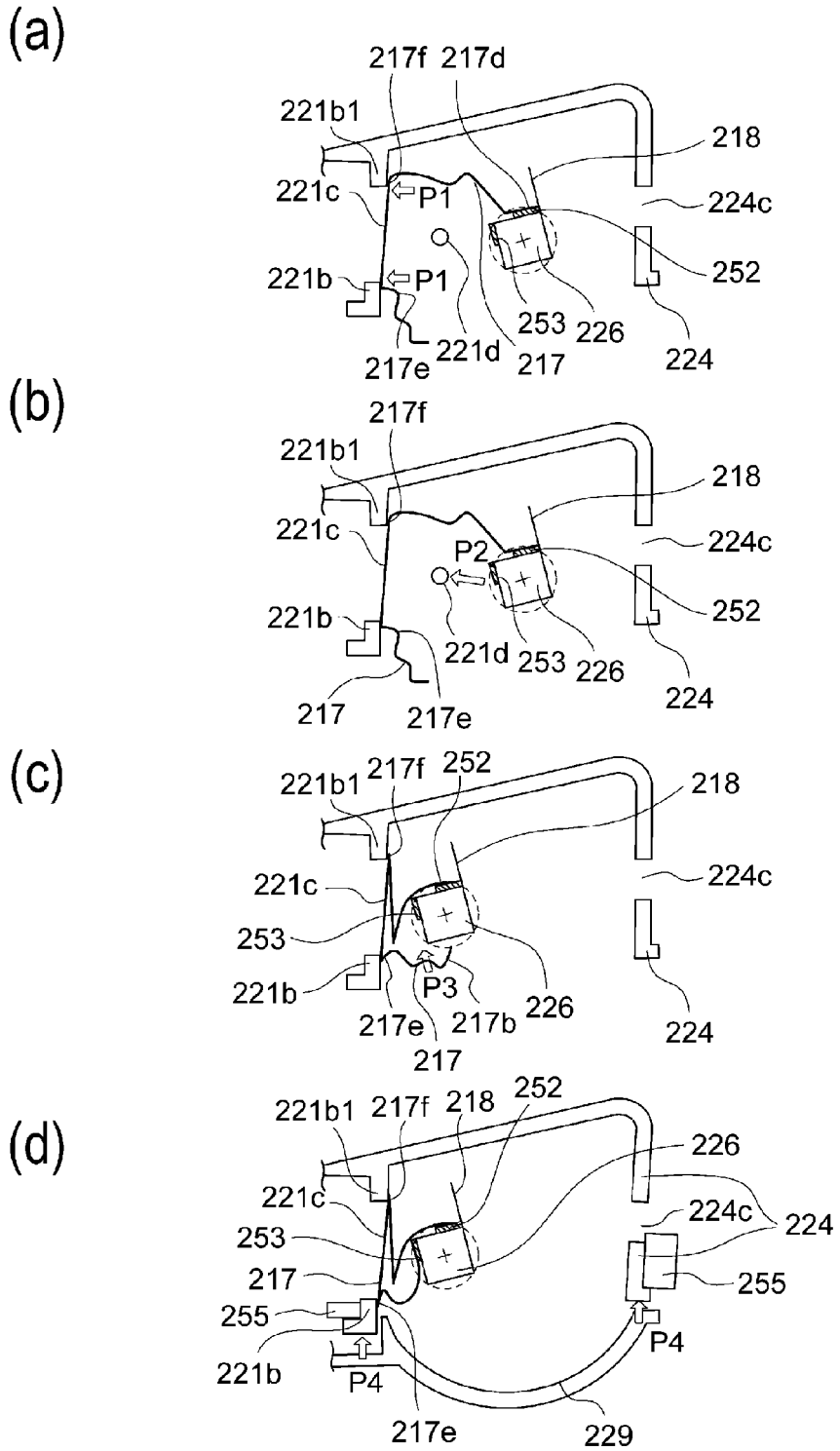
In FIG. 18, (a) to (d) are schematic sectional views for illustrating assembling of a developer accommodating unit in Fourth Embodiment.

Next, as shown in (b) of FIG. 18, the unsealing member 226 is moved in an arrow P2 direction, and is engaged in a hole portion 221*d* provided in the developing device frame 224, thus rotatably supported.

Further, as shown in (c) of FIG. 18, the first fixing portion 217*b* of the sealing member 217 is moved in an arrow P3 direction and is fixed on the double-side tape 253 of the unsealing member 226. As a result, the sealing member 217 has the two fixing portions, consisting of the first fixing portion 217*b* and the second fixing portion 217*d*, with respect to the unsealing member 226.

Further, as shown in (d) of FIG. 18, the developing device frame 224 placed on a cradle 255 and a toner container cap (cover) 229 to which a force is applied in an arrow P4 direction by a welding horn are welded by the ultrasonic welding.

Here, when the developer accommodating portion is formed by welding the developing device frame 224 and the toner container cap 229 by the ultrasonic welding, the surface of the developing device frame 224 and the surface of the toner container cap 229 are bonded to each other.

Thereafter, the toner t is filled into the developer accommodating portion 221*a* through a toner hole portion 224*c*, and then the toner hole portion 224*c* is sealed with a toner cap (not shown), a seal or the like. Here, the toner t may also be filled through the opening 221*c* of the developing device frame 224 before the ultrasonic welding between the developing device frame 224 and the toner container cap 229.

(Unsealing Method of Sealing Member)

Next, an unsealing method of the sealing member 217 will be described with reference to FIG. 16. When the process cartridge is mounted in the image forming apparatus, a driving force is transmitted to the process cartridge by a driving means (not shown) provided in the image forming apparatus, so that the unsealing member 226 is rotated in an arrow E direction as shown in (a) of FIG. 16. When the unsealing member 226 is rotated, the unsealing member 226 starts winding-up of the sealing member 217.

Further, as shown in (a) of FIG. 16, when the unsealing member 226 starts the winding-up of the sealing member 217 by the rotation thereof, the force S1 is applied at the first unsealing start portion 217*e*, so that the sealing member 217 is pulled in a direction of the force S1. Here, as described above, when an angle between the force S1 and the arrow Q1 direction is the first peeling angle θ1, the first peeling angle θ1 is 90 degrees or less. At this time, the sealing member 217 is peeled from the partition wall portion 221*b*, so that the opening 221*c* is exposed from the first unsealing start portion 217*e* in the arrow Q1 direction.

Here, as shown in (b) of FIG. 16, during the removal of the sealing member 217 in the arrow Q1 direction by the rotation of the unsealing member 226, the force S2 is applied at the second unsealing start portion 217*f*, so that the sealing member 217 is pulled in a direction of the force S2. Here, as described above, when an angle between the force S2 and the arrow Q2 direction is the second peeling angle θ2, the second peeling angle θ2 is 90 degrees or less. Further, the sealing member 217 is peeled from the partition wall portion 221*b*, so that the opening 221*c* is exposed from the second unsealing start portion 217*f* in the arrow Q2 direction.

Next, as shown in (c) of FIG. 16, when the rotation of the unsealing member 226 further advances, the sealing member 217 is wound up by the unsealing member 226, so that the opening 221*c* is completely exposed.

(Comparison Example)

Here, as Comparison Example, the case where a sealing member has a single unsealing start position will be described with reference to FIG. 19.

Figure 19:
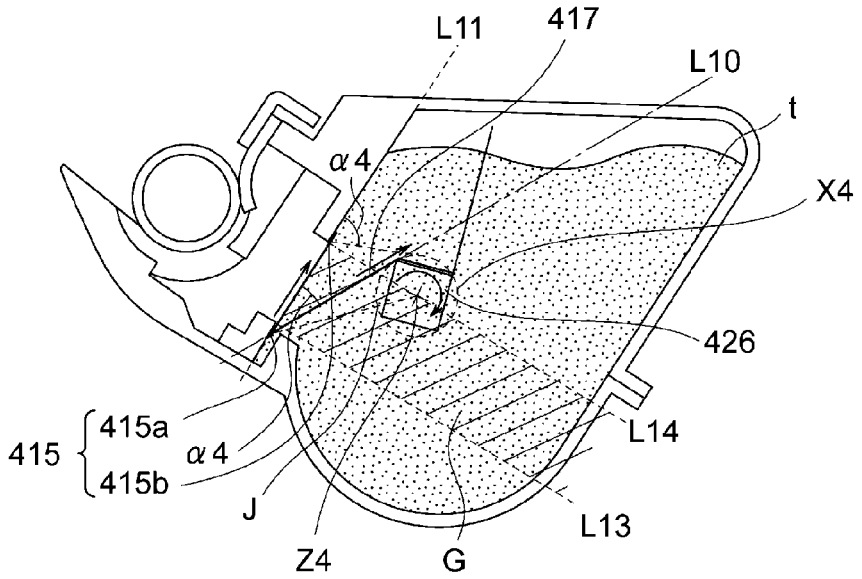
In FIG. 19, (a) and (b) are schematic views for illustrating Comparison Example to be compared with Fourth Embodiment.
Figure 19:
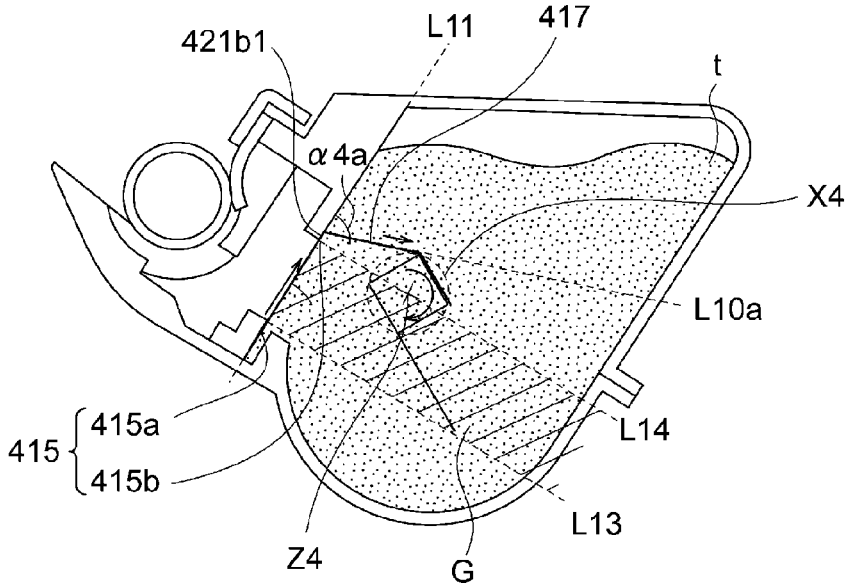

In a developer accommodating unit shown in FIG. 19, a sealing member 417 is peeled from a first bonding portion 415*a* toward a second bonding portion 415*b*. Here, as shown in (a) of FIG. 19, a circumscribed circle passing through outermost portions of an unsealing member 426 with a rotation shaft Z4 of the unsealing member 426 as a center is defined as a circle X4. Further, an intersection point where a line drawn from the first bonding portion 415*a* toward the rotation shaft Z4 crosses the circle X4 is taken as a point J. Further, a tangential line, of the circle X4, passing through the first bonding portion 415*a* and contacting the circle X4 in a downstream side of the rotational direction of the unsealing member 426 is taken as a first line L10. Further, a line connecting the first bonding portion 415*a* and the second bonding portion 415*b* is taken as a second line L11. Further, an angle formed between the first line L10 and the second line L11 is taken as α4. The angle α4 represents a peeling angle of the sealing member 417 at a pasting portion 421*b* of the first bonding portion 415*a*.

Further, as shown in (b) of FIG. 19, a tangential line, of the circle X4, passing through the second bonding portion 415*b* and contacting the circle X4 in the downstream side of the rotational direction of the unsealing member 426 is taken as a fifth line L10*a*. Further, an angle formed between the fifth line L10*a* and the second line L11 is taken as α4*a*. The angle α4*a* represents a peeling angle of the sealing member 417 at a pasting portion 421*b*1 of the second bonding portion 415*b*.

Here, a line perpendicular to the second line L11 and passing through the first bonding portion 415*a* is taken as a third line L13, a line perpendicular to the second line L11 and passing through the second bonding portion 415*b* is taken as a fourth line L14, and a range (region) formed between the third line L13 and the fourth line L14 is defined as a range G. Further, the unsealing member 426 rotates about the rotation shaft Z4 in an arrow H direction, thus winding up the sealing member 417.

That is, in order that each of the angles α4 and α4*a* is 90 degrees or less, the unsealing member 426 is disposed so that a peeling off force acts on the sealing member 417 from a point on the fourth line L14, on the third line L13 or outside the range G. As a result, the first bonding portion 415*a* is peeled off from the fourth line L14 side rather than the third line L13 side, and the second bonding portion 415*b* is peeled off from the third line L13 side rather than the fourth line L14 side.

For this reason, when the developer accommodating portion 421*a* is designed as a small-sized portion, a size of the developer accommodating portion 421*a* is larger than at least the range G.

On the other hand, in the above-described embodiments of the present invention, the sealing member 217 sealing the opening 221*c* has the two fixing portions, with respect to the unsealing member 226, consisting of the first fixing portion 217*b* and the second fixing portion 217*d*. Further, by providing the plurality of unsealing start positions of the bonding portion 215, even when the unsealing member 226 is disposed in the range formed by the lines perpendicular to the opening 221*c* and the bonding portions 215, it becomes possible to peel off the sealing member 217 by the inclination peeling.

Therefore, the circumscribed circle of the unsealing member 426 can be disposed, as shown in FIG. 16, between the line L1 perpendicular to the sealing portion 217*a* and passing through the first unsealing start portion 217*e* and the line L2 perpendicular to the sealing portion 217*a* and passing through the second unsealing start portion 217*f*. As a result, the process cartridge can be downsized.

Further, by providing the plurality of unsealing start positions, the sealing member 217 is started to be peeled off, while being peeled off from one unsealing start position, also from the other unsealing start position, or is peeled off from the plurality of unsealing start positions simultaneously, and therefore compared with the developer accommodating container having the single unsealing start position or the developing device having the single unsealing start position, an unsealing time is short. In this way, the unsealing time is shortened, so that the toner can be supplied quickly to the developing chamber and thus a first sheet print time is shortened.

Incidentally, the constitution in which the unsealing member 226 and the sealing member are disposed inside the developer accommodating portion may be as shown in FIG. 17. That is, a connecting portion from the first fixing portion 217*b* and the second fixing portion 217*d* which are unsealing member mounting portions of the sealing member 217 may be provided with a plurality of holes 217*g*. As a result, as shown in FIG. 16, when the sealing member 217 is wound up inside the developer accommodating portion by rotating the unsealing member 217, the developer escapes through the holes 217*g*, and therefore it becomes possible to suppress an increase in winding-up torque.

(Embodiment in which Unsealing Member is Provided Outside Developer Accommodating Portion)

Figure 20:
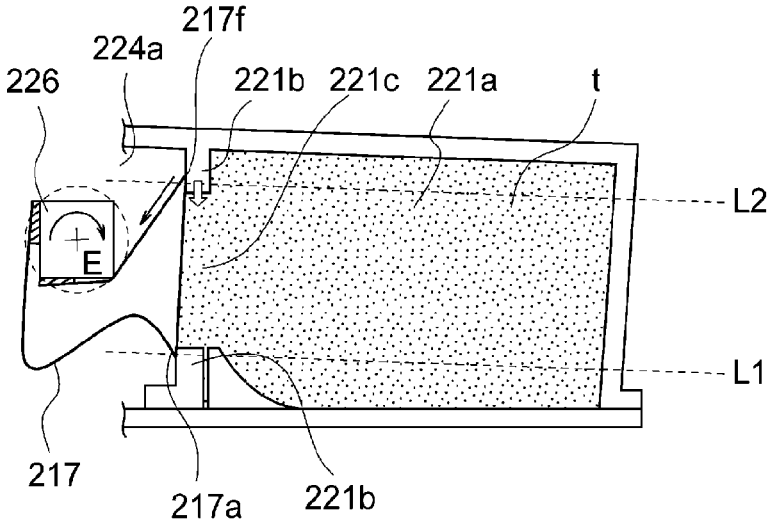
FIG. 20 is an illustration of another example of Fourth Embodiment.
Figure 21:
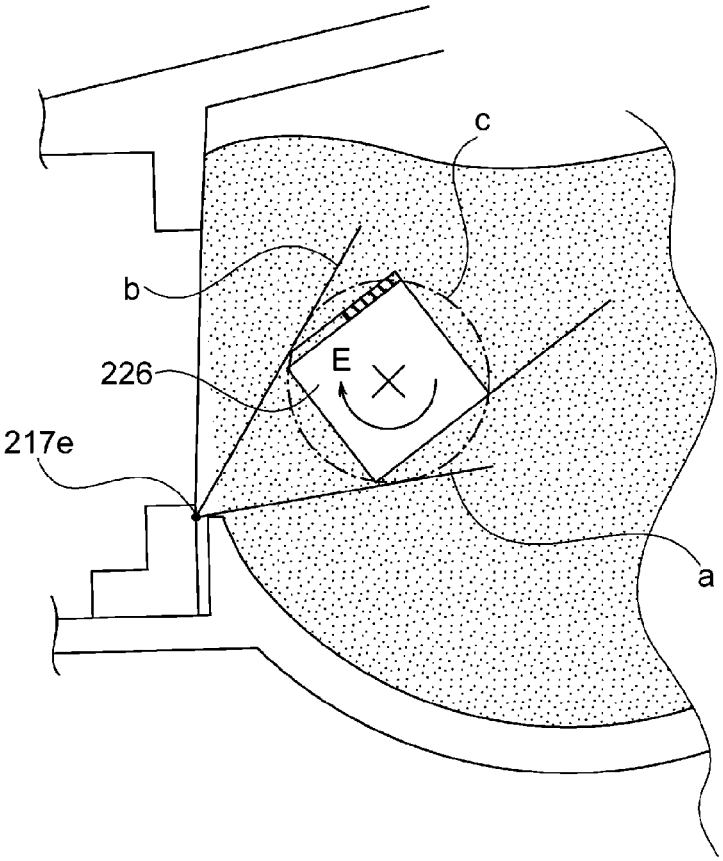
FIG. 21 is an illustration of a line which is a circumscribed circle of the unsealing member and which contacts the unsealing member in a downstream side of a rotational direction of the unsealing member.

In the embodiment shown in FIG. 16, the unsealing member 226 was provided inside the developer accommodating portion 221*a*. However, as shown in FIG. 20, the unsealing member 226 may also be provided outside the developer accommodating portion 221*a*. Also in this case, a similar effect can be obtained even when the unsealing member 226 is disposed so that the circumscribed circle of the unsealing member 226 enters a range, between the line L1 perpendicular to the sealing portion 217*a* and passing through the first unsealing start portion 217*e* and the line L2 perpendicular to the sealing portion 217*a* and passing through the second unsealing start portion 217*f*, after two unsealing start positions are provided.

According to the present invention, it becomes possible to peel off the sealing member from the accommodating portion such as the developer accommodating unit in a short time, so that the unsealing time required for unsealing (exposing) the opening is shortened.

While the invention has been described with reference to the structures disclosed herein, it is not confined to the details set forth and this application is intended to cover such modifications or changes as may come within the purpose of the improvements or the scope of the following claims.

This application claims priority from Japanese Patent Applications Nos. 118885/2013 filed Jun. 5, 2013 and 056386/2014 filed Mar. 19, 2014, which are hereby incorporated by reference.

What is claimed is:

1. A developer accommodating unit for accommodating developer, said developer accommodating unit comprising:

an accommodating portion, provided with an opening, for accommodating the developer;

a sealing member for sealing the opening; and an unsealing member rotatable for winding up said sealing member, wherein said sealing member is peelable from said accommodating portion to unseal the opening in a first unsealing direction and a second unsealing direction that is opposite to the first unsealing direction, wherein the first unsealing direction is a direction from an upstream side of the opening to a downstream side of the opening with respect to a rotational direction of said unsealing member, and wherein the second unsealing direction is a direction from a downstream side of the opening to an upstream side of the opening with respect to a rotational direction of said unsealing member.

2. A developer accommodating unit according to claim 1, wherein unsealing in the first unsealing direction is performed earlier than unsealing in the second unsealing direction.

3. A developer accommodating unit according to claim 1, wherein a widthwise direction of the opening is the same direction as the first unsealing direction.

4. A developer accommodating unit according to claim 1, wherein said accommodating portion is locatable at a first unsealing start position where exposure of the opening is started and a second unsealing start position, and wherein said unsealing member is provided so that an angle formed between a line connecting the first unsealing start position and the second unsealing start position and a tangential line, of tangential lines each passing through the first unsealing start position and contacting a circumscribed circle of said unsealing member, contacting the circumscribed circle in a downstream side of a rotational direction of said unsealing member is 90 degrees or less.

5. A developer accommodating unit according to claim 4, wherein, when the first unsealing start position and the second unsealing start position are disposed with respect to a direction of gravitation, said unsealing member is disposed between the first unsealing start position and the second unsealing start position with respect to the direction of gravitation.

6. A developer accommodating unit according to claim 1, wherein said accommodating portion is locatable at a first unsealing start position where exposure of the opening is started and a second unsealing start position, and wherein said unsealing member is provided so that an angle formed between a line connecting the second unsealing start position and the first unsealing start position and a tangential line, of tangential lines each passing through the second unsealing start position and contacting a circumscribed circle of said unsealing member, contacting the circumscribed circle in a downstream side of a rotational direction of said unsealing member is 90 degrees or less.

7. A developer accommodating unit according to claim 1, wherein at least one unsealing in the first unsealing direction and unsealing in the second unsealing direction is performed during one full turn of said unsealing member.

8. A developer accommodating unit according to claim 1, wherein said accommodating portion has a side including the opening, and wherein the first unsealing direction and the second unsealing direction are parallel to the side including the opening.

9. A developer accommodating unit according to claim 1, wherein the opening is provided at a point, of said accommodating portion, closest to a rotation shaft of said unsealing member.

10. A developer accommodating unit according to claim 1, wherein said accommodating portion is provided with at least two openings.

11. A developer accommodating unit according to claim 10, wherein the openings include at least one opening provided each of downstream and upstream of a point of said accommodating portion with respect to a rotational direction of said unsealing member closest to a rotation shaft of said unsealing member, and wherein said sealing member is removed, by rotation of said unsealing member, from a side remote from the closest point toward the closest point.

12. A developer accommodating unit according to claim 10, wherein said unsealing member includes a first unsealing member and a second unsealing member which seal different openings.

13. A developer accommodating unit according to claim 1, wherein said sealing member forms a fold back portion that is folded back at an angle of 90 degrees or less when said sealing member is wound up by rotation of said unsealing member.

14. A developer accommodating unit according to claim 1, wherein said accommodating portion is a flexible container, and wherein said developer accommodating unit further comprises a frame for accommodating said flexible container.

15. A developer accommodating unit according to claim 1, wherein said unsealing member is provided inside said accommodating portion.

16. A developer accommodating unit according to claim 1, wherein said unsealing member is provided outside said accommodating portion.

17. A developer accommodating unit according to claim 1, wherein said sealing member is provided with a plurality of holes at a connecting portion of said unsealing member from a mounting portion to a sealing portion.

18. A developing device comprising:

a developer accommodating unit according to claim 1; and a developer carrying member for carrying developer supplied from said developer accommodating unit.

19. A process cartridge comprising:

either one of a developer accommodating unit according to claim 1 and a developing device according to claim 18; and an image bearing member.

20. An image forming apparatus comprising:

one of a developer accommodating unit according to claim 1, a developing device according to claim 18, and a process cartridge according to claim 19, wherein a developer image is transferred onto a recording material at a transfer portion.

21. A developer accommodating unit according to claim 1, wherein the first and second unsealing directions are parallel to a phantom plane including the opening.

22. A developer accommodating unit for accommodating developer, said developer accommodating unit comprising:

an accommodating portion, provided with an opening, for accommodating the developer;

a sealing member for sealing the opening; and an unsealing member rotatable for winding up said sealing member, wherein said sealing member includes a sealing portion for sealing the opening, first and second mounting portions mounted on said unsealing member, first connecting portion provided between said sealing portion and said first mounting portion, and a second connecting portion provided between said sealing portion and said second mounting portion, wherein said accommodating portion includes a first bonding portion and a second bonding portion each being bonded to said sealing portion via the opening, wherein said first connecting portion peels said sealing portion from said first bonding portion with rotation of said unsealing member, and wherein said second connecting portion peels off said sealing portion from said second bonding portion with the rotation of said unsealing member.

* * * * *